US011591786B2

(12) United States Patent
Helmstetter et al.

(10) Patent No.: US 11,591,786 B2
(45) Date of Patent: Feb. 28, 2023

(54) TOILET ASSEMBLY

(71) Applicant: AS America, Inc., Piscataway, NJ (US)

(72) Inventors: Christopher Helmstetter, Langhorne, PA (US); David Grover, Stockton, NJ (US); Yasuhiro Kondo, Aichi (JP); Douglas Leavitt, Bethlehem, PA (US); Ronald D. Barndt, Bethlehem, PA (US)

(73) Assignee: AS America, Inc., Piscataway, NJ (US)

( * ) Notice: Subject to any disclaimer, the term of this patent is extended or adjusted under 35 U.S.C. 154(b) by 99 days.

(21) Appl. No.: 17/271,865

(22) PCT Filed: Aug. 30, 2019

(86) PCT No.: PCT/US2019/049000
§ 371 (c)(1),
(2) Date: Feb. 26, 2021

(87) PCT Pub. No.: WO2020/047379
PCT Pub. Date: Mar. 5, 2020

(65) Prior Publication Data

US 2021/0317649 A1 Oct. 14, 2021

Related U.S. Application Data

(60) Provisional application No. 62/795,491, filed on Jan. 22, 2019, provisional application No. 62/730,862, filed on Sep. 13, 2018, provisional application No. 62/725,640, filed on Aug. 31, 2018.

(51) Int. Cl.
*E03D 11/18* (2006.01)
*E03D 11/16* (2006.01)

(52) U.S. Cl.
CPC ..... *E03D 11/18* (2013.01); *E03D 11/16* (2013.01); *E03D 2201/30* (2013.01)

(58) Field of Classification Search
CPC ..... E03D 11/16; E03D 11/18; E03D 2201/30
See application file for complete search history.

(56) References Cited

U.S. PATENT DOCUMENTS

| | | | | |
|---|---|---|---|---|
| 6,108,826 | A | 8/2000 | Hayashi et al. | |
| 6,292,956 | B1 * | 9/2001 | Kayahara | E03D 11/13 4/421 |
| 9,212,478 | B2 | 12/2015 | Laundre et al. | |
| 9,719,239 | B2 * | 8/2017 | Bhardwaj | E03D 11/08 |
| 10,151,095 | B2 | 12/2018 | Coronado et al. | |

(Continued)

OTHER PUBLICATIONS

International Search Report dated Nov. 21, 2019 in corresponding International Application No. PCT/US2019/049000 (2 pages).

*Primary Examiner* — Janie M Loeppke
(74) *Attorney, Agent, or Firm* — Tyler A. Stevenson; Anna-lisa L. Gallo

(57) ABSTRACT

A skirted toilet assembly, comprising a toilet bowl having a sump outlet; and a wall extending around the bowl from a first rear edge to a second rear edge; wherein the wall, the first rear edge, and the second rear edge define a space within the wall, the sump outlet is configured to couple to a trapway, the trapway is configured to fluidly couple the sump outlet with a sewer outlet, and the trapway is configured to be disposed within the space. A trapway may be a thermoplastic and the sump outlet a ceramic.

19 Claims, 22 Drawing Sheets

(56) References Cited

U.S. PATENT DOCUMENTS

| | | | | |
|---|---|---|---|---|
| 2008/0047053 | A1 | 2/2008 | Grech et al. | |
| 2009/0007323 | A1 | 1/2009 | Cambell et al. | |
| 2010/0125940 | A1 | 5/2010 | Sigler et al. | |
| 2013/0219605 | A1 | 8/2013 | Grover et al. | |
| 2013/0312173 | A1 | 11/2013 | Wu et al. | |
| 2013/0340156 | A1 | 12/2013 | McHale et al. | |
| 2014/0026311 | A1 | 1/2014 | Bernabei et al. | |
| 2015/0074893 | A1 | 3/2015 | Veros et al. | |
| 2015/0267388 | A1 | 9/2015 | Bhardwaj et al. | |
| 2016/0024774 | A1* | 1/2016 | Stack | E03D 11/00 4/420 |
| 2018/0112383 | A1* | 4/2018 | Le | E03D 11/02 |

* cited by examiner

TOILET ASSEMBLY

The disclosure relates to a toilet assembly comprising a sump connection for coupling a trapway to a toilet. In some embodiments, the disclosure relates to a toilet assembly having a trapway that may be concealed within sidewalls of the assembly. In some embodiments, the disclosure relates to a connection for coupling a plastic trapway to a ceramic toilet.

BACKGROUND

Current technology for connecting a toilet bowl to a sewer line requires a trapway. A trapway typically extends between a sump of a toilet bowl and a base opening of a toilet. A trap inlet is coupled in a sump area of the toilet bowl and a trap outlet is coupled to an opening in the base of the toilet. The toilet base opening and trap outlet are coupled to a sewer drain pipe. A trapway allows for flow of water and waste from the toilet bowl to outlet pipes of a building and to a sewer system. A trapway functions in combination with a trap to prevent sewer gases from coming back into the toilet. In general, toilets include a trapway molded into the chinaware and the profile of the trapway is visible from the outside of the toilet. Molding the trapway in chinaware may avoid connection and sealing issues, but may be time consuming and expensive. There is a need for a trapway that is a separate part from the toilet and may be reliably coupled to the toilet. There is a further aesthetic need for a trapway that may be concealed by sidewalls of the toilet. There is a further need for a connection that can securely couple a trapway to a toilet in a fluid tight manner. There is a further need for a manner to couple the trapway to a toilet in a fluid tight manner without additionally mechanical components.

SUMMARY

Accordingly, disclosed is a toilet assembly, comprising a toilet bowl having a sump outlet; and a wall extending around the bowl from a first rear edge to a second rear edge; wherein the wall, the first rear edge, and the second rear edge define a space within the wall, the sump outlet is configured to couple to a trapway, the trapway is configured to fluidly couple the sump outlet with a sewer outlet, and the trapway is configured to be disposed within the space.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The disclosure is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Disclosed are toilet assemblies configured for having a concealed trapway, or "skirted" toilets. The toilets may be wall-hung or floor standing. The toilets may have a tank, in some instances an in-wall tank. A trapway may be coupled to a sump outlet of a toilet with a sump connection. A trapway is configured to fluidly couple a sump outlet of a toilet with a sewer drain pipe (sewer outlet). A sewer outlet may be in a floor aligned substantially vertically or may be in a wall, aligned substantially horizontally. A toilet may have a rim flush channel and a jet flush channel.

Figure 1:
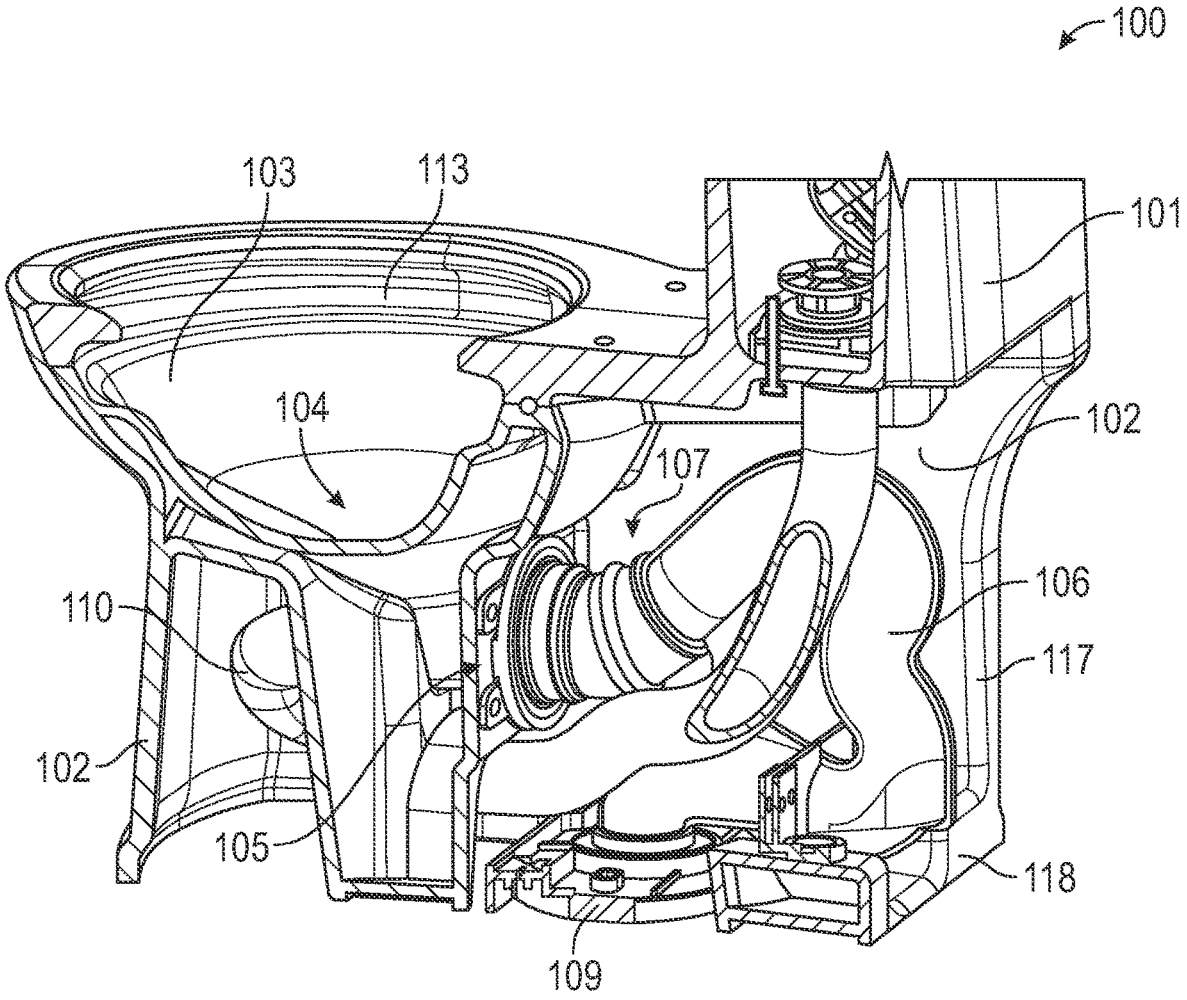
FIG. 1 shows a partial cross-section view of a toilet having a trapway and jet channel, according to an embodiment.
Figure 2:
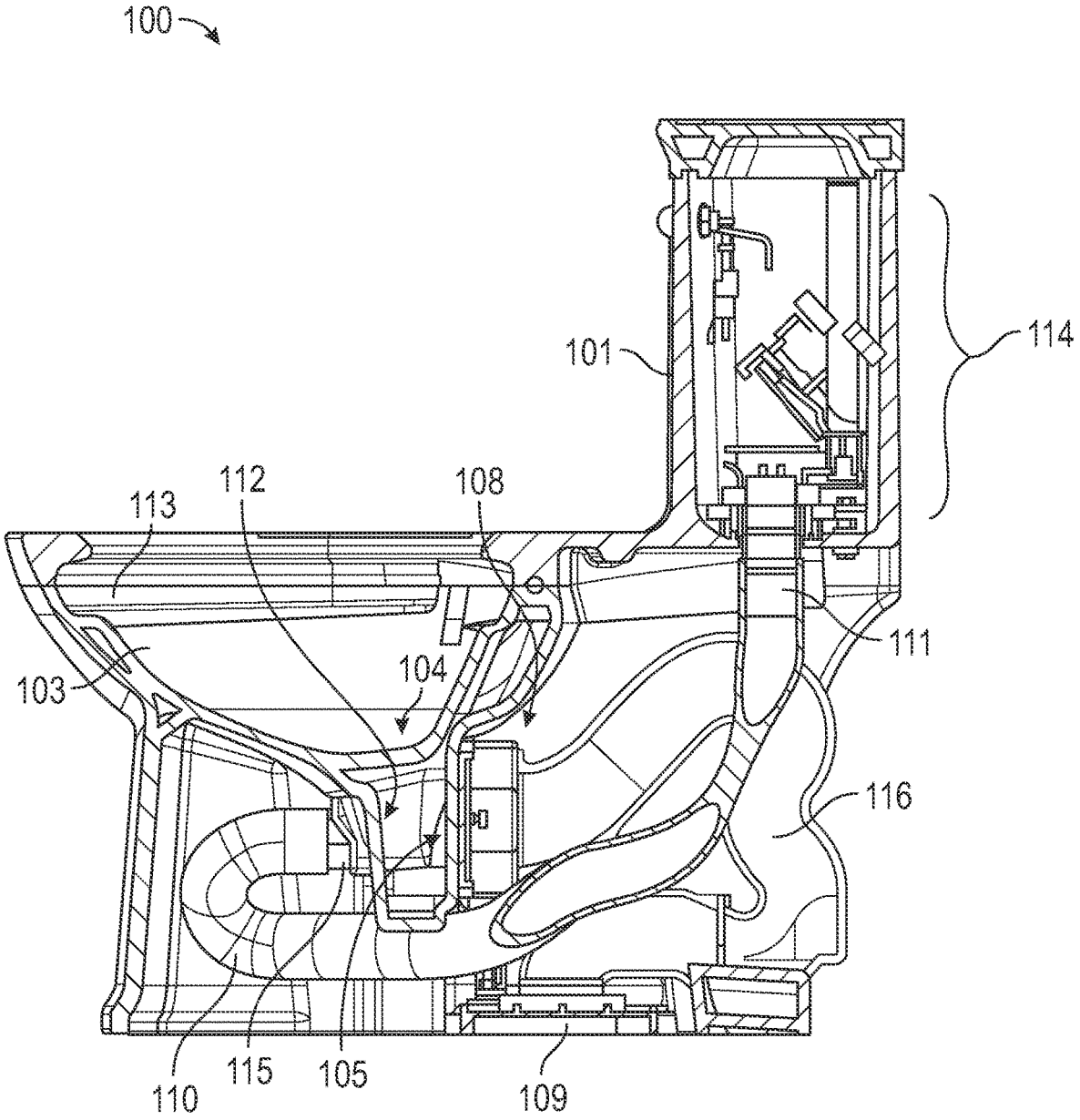
FIG. 2 shows a partial cross-section view of a toilet having a trapway and jet channel, according to an embodiment

FIG. 1 and FIG. 2 show a cross-section view of toilet assemblies 100, according to some embodiments. Shown are tank 101, wall 102, and bowl 103. Tank 101, wall 102, and bowl 103 may comprise a chinaware main body and may be formed of porcelain. Bowl 103 comprises sump area 104 in flow communication with sump outlet 105. Sump outlet 105 of FIG. 1 is coupled to trapway 106 via sump connection 107. Sump connection 107 comprises a flexible sleeve. Sump outlet 105 of FIG. 2 is coupled to trapway 116 via sump connection 108. Trapways 106 and 116 extend from sump outlet 105 to a trapway outlet (not visible). Trapways 106 and 116 are configured to couple to a sewer outlet in a floor (not shown) via drain connection 109. Rear edge 117 is coupled to bridge 118.

Toilet assembly 100 includes jet channel pipe, or simply jet channel 110. Jet channel 110 extends from jet channel inlet 111 to jet channel outlet 112. Jet channel outlet 112 may be coupled to jet channel 110 via a jet connection, such as jet nozzle 115. Jet channel 110 is shown in a partially-open cross-section view. Jet channel 110 is substantially tubular having solid walls. Jet channel 110 may be a hose comprising a rubber or a thermoplastic, e.g. ethylene propylene diene monomer rubber (EPDM). Jet channel 110 may be clamped to jet nozzle 115 with a hose clamp. Jet channel 110 may be a flexible hose.

Toilet assembly 100 of FIG. 2 shows flushing system 114 for effectuating a flush. Flushing system 114 may comprise a handle, one or more flush valves, and one or more linkages between a handle and each of the one or more flush valves. For example, flushing system 114 may comprise a rim flush valve and a jet flush valve. Operation of a handle may allow water from the tank to flow through a rim flush valve, a jet flush valve, or a combination of both a rim flush valve and a jet flush valve. Water flowing through a rim flush valve may flow through a rim path 113 of bowl 103. Water flowing through a jet flush valve may enter jet channel 110 through jet channel inlet 111. Water flowing through jet channel 110 may enter bowl 103 in sump area 104 at jet channel outlet 112.

Figure 3A:
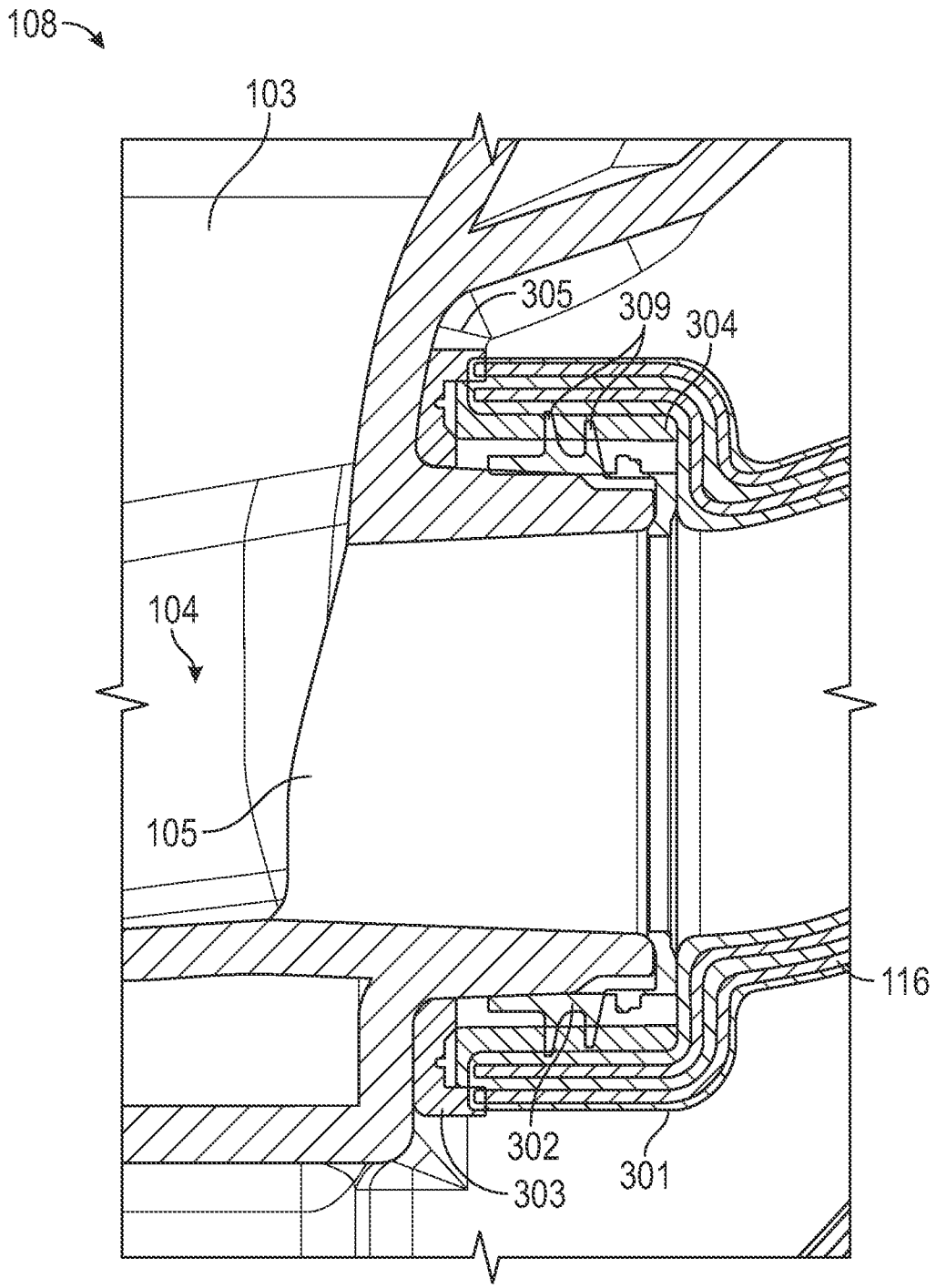
FIG. 3*a* shows a partial side cross-section view of a sump outlet of a toilet attached to the trapway, according to an embodiment.
Figure 3B:
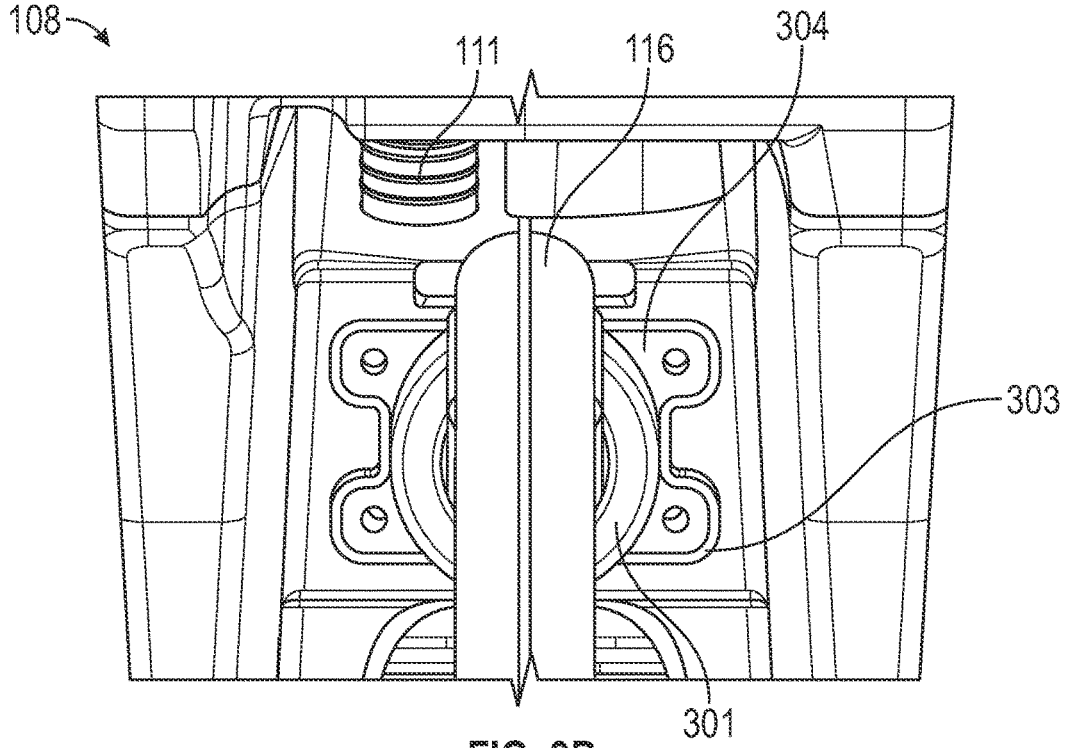
FIG. 3*b* shows a partial rear view of the sump outlet of FIG. 3*a* attached to a trapway, according to an embodiment.
Figure 3C:
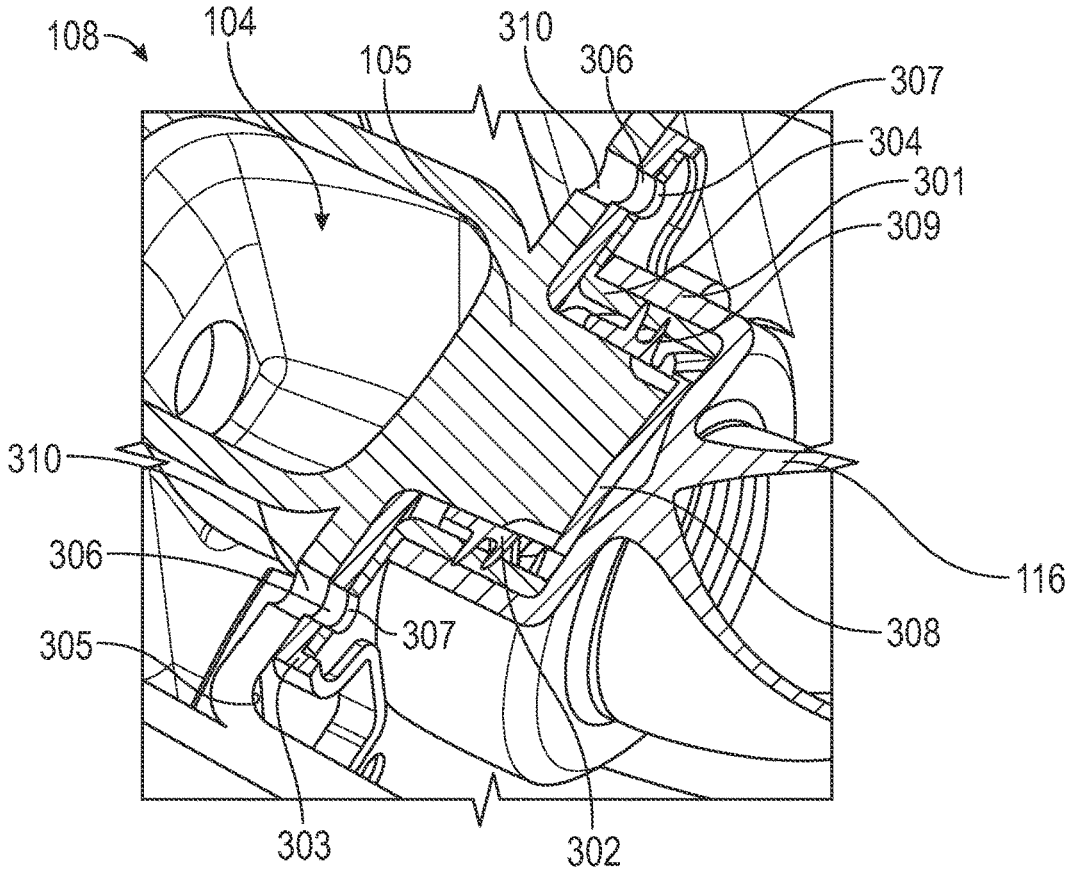
FIG. 3*c* shows a partial top cross-section of the sump outlet of FIG. 3*a* attached to a trapway, according to an embodiment.

FIG. 3*a*, FIG. 3*b*, and FIG. 3*c* show an enlarged view of a sump connection 108, according to some embodiments. Sump connection 108 includes enlarged portion 301, primary seal 302, secondary seal 303, and ring 304. Sump connection 108 may provide a fluid tight connection between sump outlet 105 and trapway 116. Primary seal 302 and secondary seal 303 may be seal gaskets. Ring 304 may be a polyvinyl chloride (PVC) ring. Primary seal 302, secondary seal 303, and ring 304 may allow for a trapway 116 formed of plastic to be secured or coupled to a porcelain or ceramic outer surface 305 of bowl 103. Secondary seal 303 and ring 304 may be mounted to outer surface 305 with one or more fasteners (not depicted) extending through one or more secondary seal mounting holes 306 and one or more ring mounting holes 307. Mounting holes 306 and 307 are aligned with mounting holes 310. In an embodiment, the one or more fasteners may be anchor bolts with inverted nut sets. The one or more fasteners may be a M6×30 mm bolt. A washer, such as a 6 mm×18 mm×1.5 mm washer, may be included between the fastener and a face of ring 304. Outer surface 305 at sump outlet 105 may not be glazed (may be un-glazed) to provide for an improved connection. An inner surface of enlarged portion 301 may abut primary seal 302 at flexible joint 308.

Primary seal 302 comprises radial flanges or radial protrusions 309 as seen in FIG. 3*a* and FIG. 3*c*. Primary seal 302 may have an inner diameter substantially the same as an outer diameter of a sump outlet. Radial protrusions 309 may extend outward from an outer diameter of primary seal 302. In some embodiments, protrusions 309 may each have a substantially equivalent outer diameter. In other embodiments, each protrusion may have a smaller outer diameter than a preceding protrusion, such that an outer diameter gradually decreases along a length of a seal body. Protrusions 309 may abut or touch an inner diameter of ring 304. Protrusions 309 may be flexible such that they bend or curve when installed between sump outlet 105 and ring 304. Radial protrusions 309 may create a seal between sump outlet 105 and trapway 116 such that no fluid is permitted to exit or leak from the connection between sump outlet 105 and the trapway 116. When assembled, primary seal 302 may be radially located between sump outlet 105 and ring 304 and longitudinally located between secondary seal 303 and trapway 116.

Figure 4A:
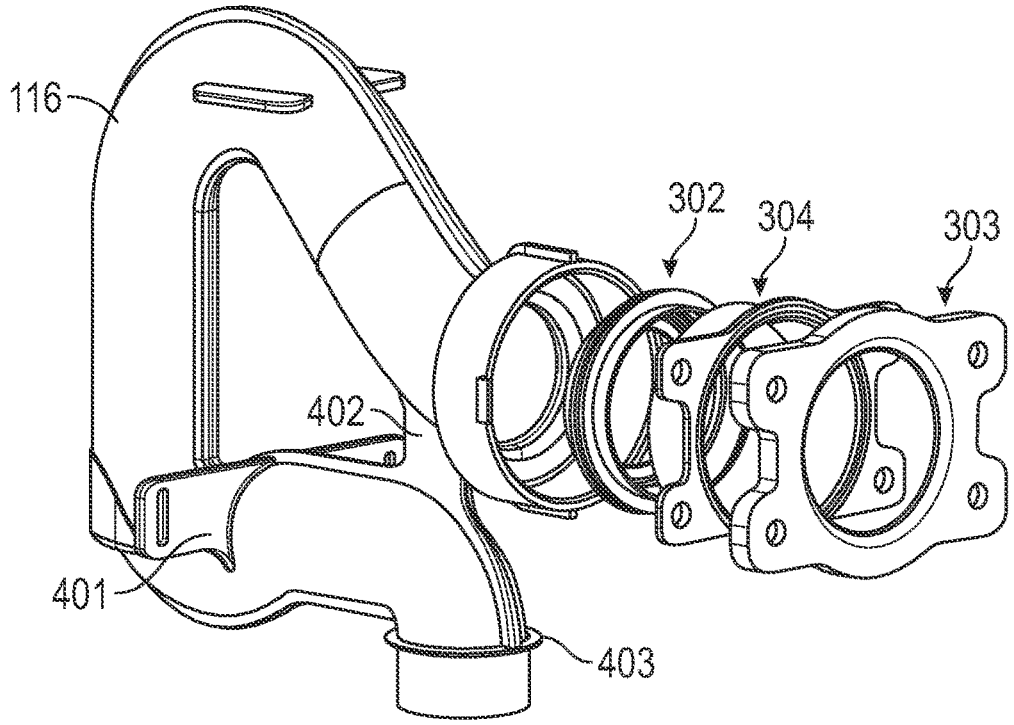
FIG. 4*a* and FIG. 4*b* show an exploded perspective view of a trapway having a sump connection, according to an embodiment
Figure 4B:
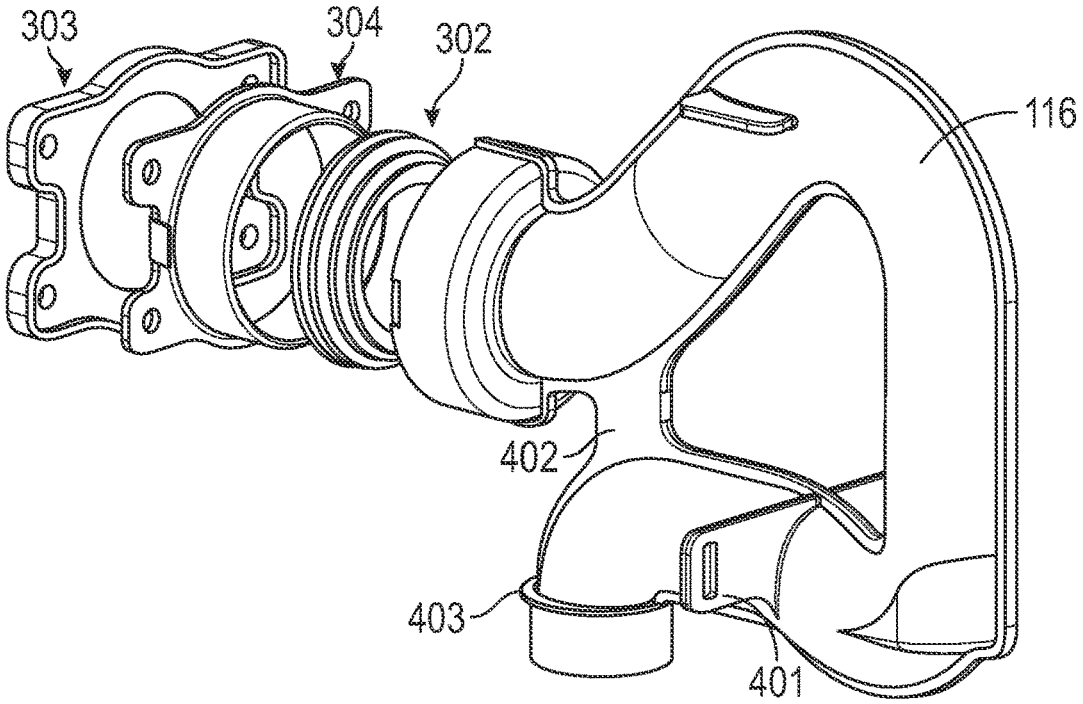

FIG. 4*a* and FIG. 4*b* show an exploded view of a trapway 116, primary seal 302, secondary seal 303, and ring 304. Trapway 106 contains flange 401 and connecting support arm 402. Trapway 116 may comprise a plastic, for instance a rigid plastic. Trapway 106 may be formed via molding. In some embodiments, trapway 116 may comprise two halves bonded together. Bonding includes one or more of ultrasonic bonding, chemical (e.g. adhesive) bonding, welding, etc. Flange 401 is configured for coupling trapway 116 to a toilet bridge. Flange 401 comprises one or more apertures for receiving fasteners for coupling. Trapway 116 comprises flange 403 for coupling to a drain connection.

Figure 5:
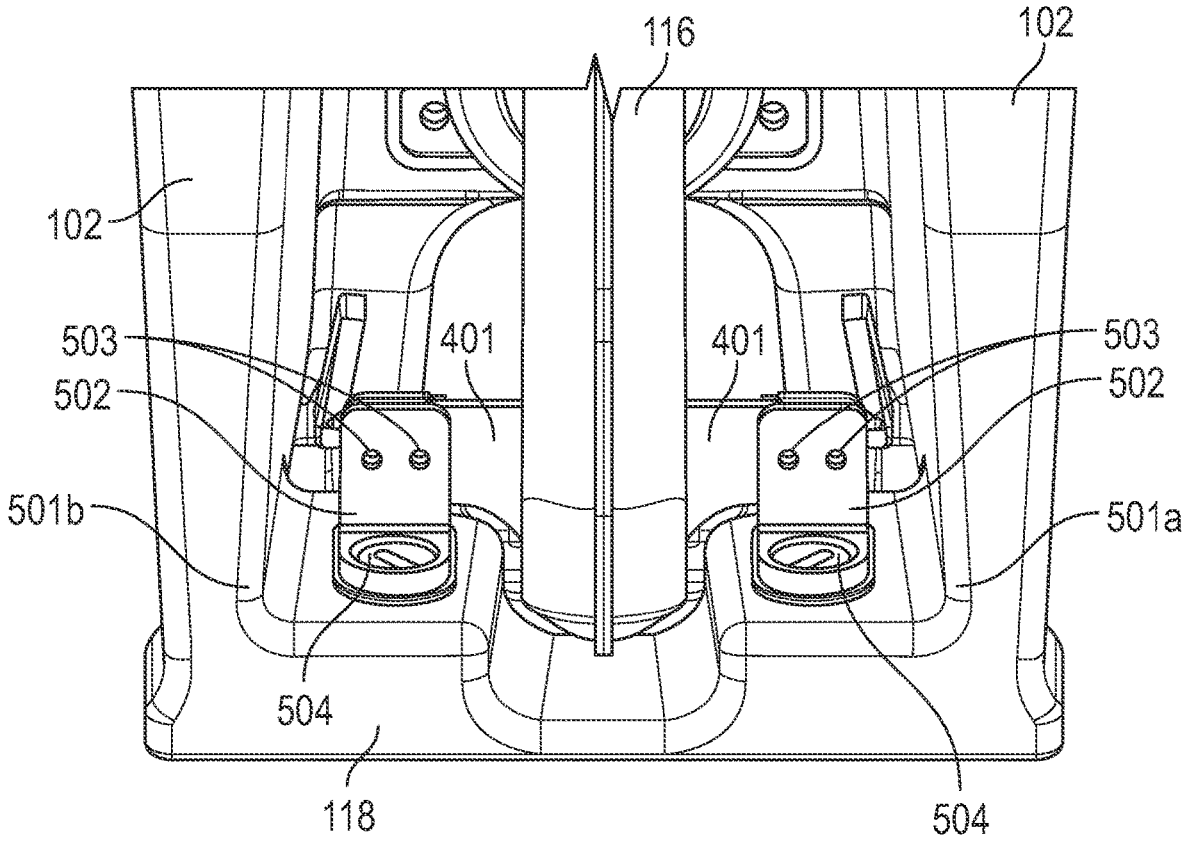
FIG. 5 shows a partial rear view of a toilet with a trapway and trap connections, according to an embodiment.

FIG. 5 provides a partial rear view of a toilet illustrating coupling of a trapway 116 to a bridge 118. Trapway 116 is mounted on a bridge section 118 which couples wall 102 from rear edge 501*a* to rear edge 501*b*. Fixing parts 502 contain mounting holes 503 for coupling to trapway flange 401. Fixing parts 502 are connected to bridge 118 at connection points 504 via mounting holes in the bridge (not visible). Wall 102 conceals trapway 116 from view.

Figure 6:
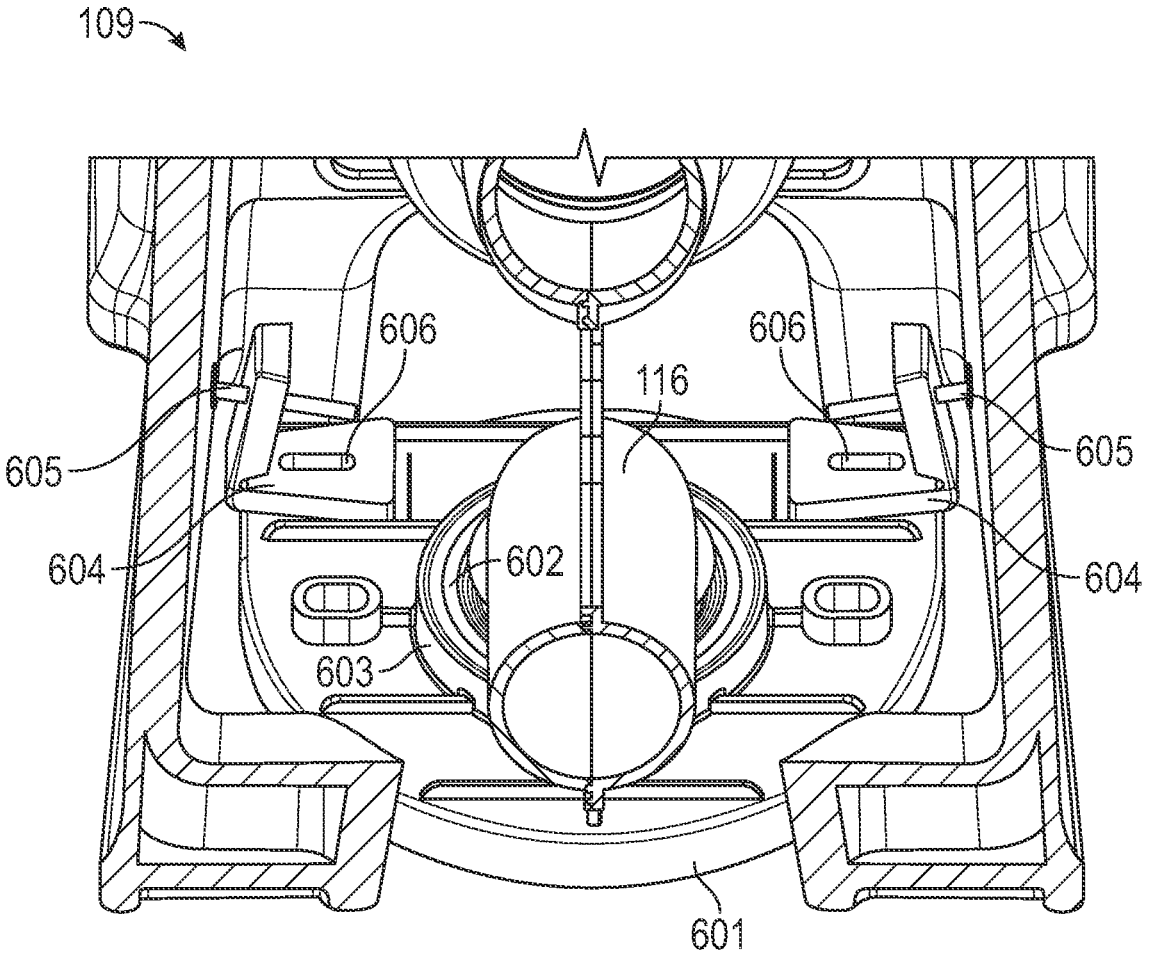
FIG. 6 shows a partial rear view of a drain connection for a trapway of a toilet, according to an embodiment.

FIG. 6 depicts a partial rear view of a trapway drain connection 109, according to an embodiment. Drain connection 109 includes flange 601, gasket 602, and ring 603. Drain connection 109 is configured to align a trapway outlet with a drain opening in a floor (not visible). Connection brackets 604 are coupled to toilet walls via fasteners 605. Brackets 604 contain openings 606 for coupling to flange 601.

Figure 7:
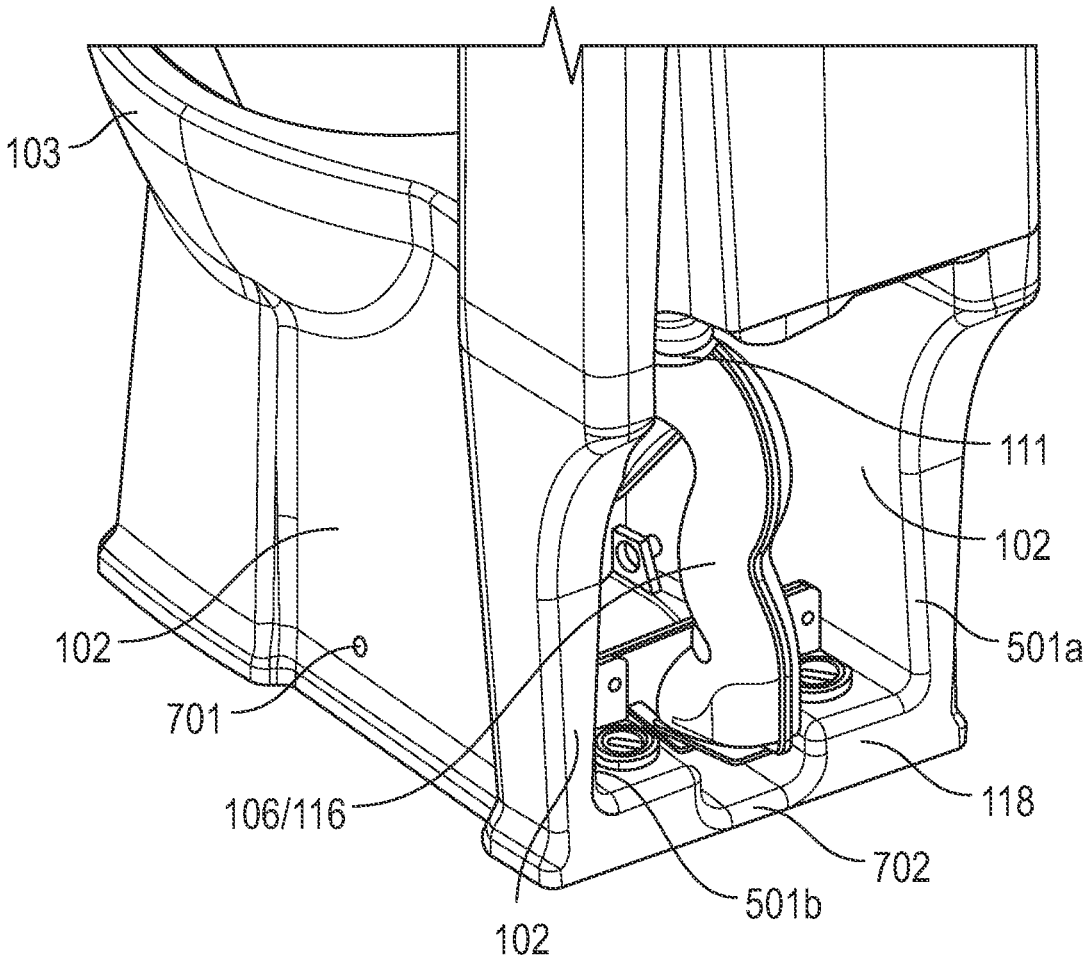
FIG. 7 shows a partial rear view of a toilet, according to an embodiment.

FIG. 7 shows a partial rear perspective view of a toilet, according to an embodiment. Visible are trapway 106, wall 102, toilet bowl 103, and bridge section 118. Bridge 118 couples wall 102 from rear edge 501*a* to rear edge 501*b*. Shown also is jet channel inlet 111 (jet channel is not shown). Opening 701 is configured to receive a fastener 605 of FIG. 6. Bridge 118 comprises a recess 702 configured to receive a heel of trapway 106 or 116.

Figure 8:
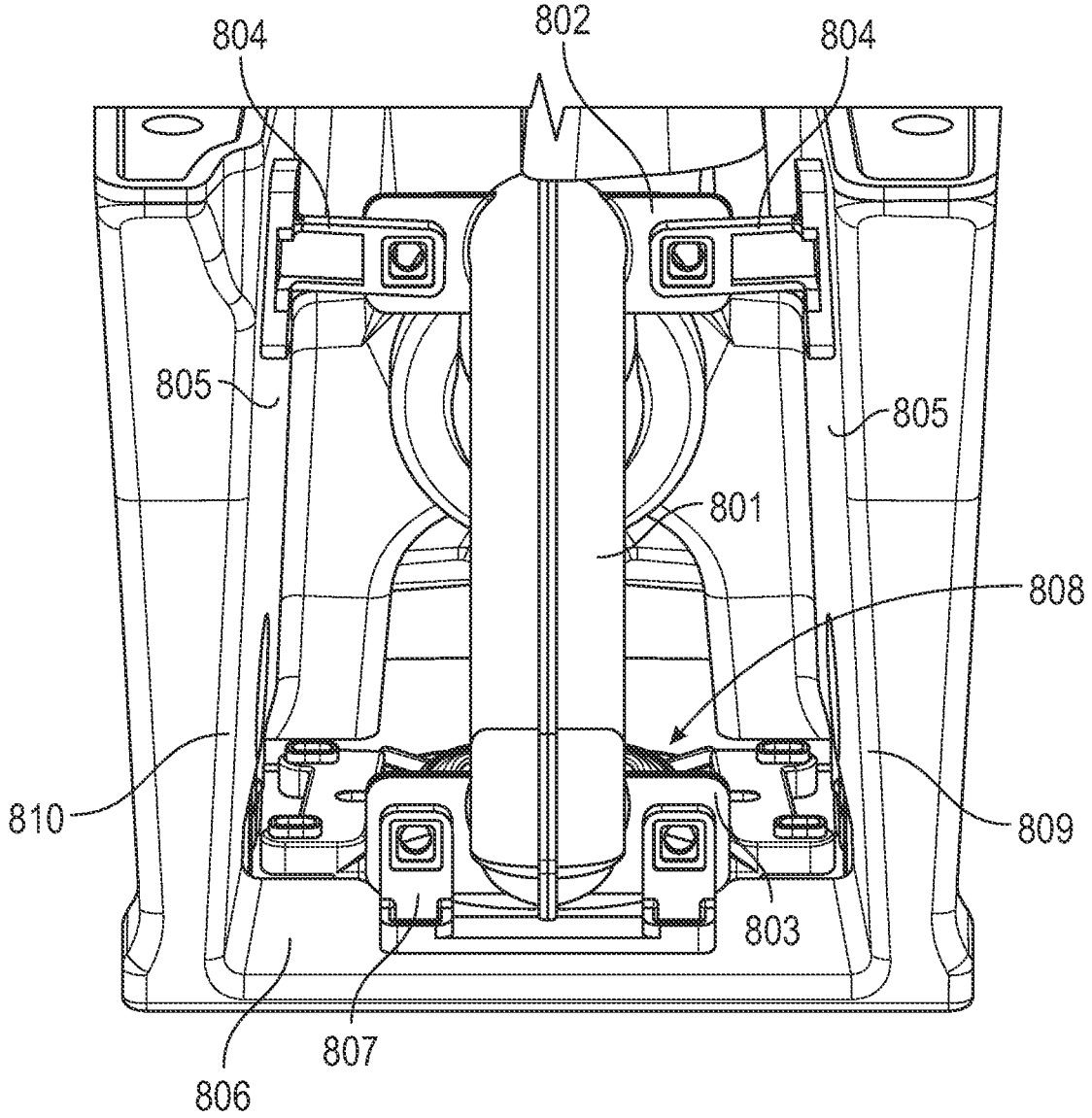
FIG. 8 shows a rear view of a toilet with a trapway and trap connections, according to an embodiment.

FIG. 8 shows a rear view of a toilet containing a trapway, according to another embodiment. Trapway 801 contains flanges 802 and 803. Flange 802 is configured to couple to wall 805 via fixing parts 804. Flange 803 is configured to couple to bridge 806 via fixing part 807. Trapway outlet 808 is in front of flange 803. Bridge 806 couples wall 805 from rear edge 809 to rear edge 810.

Figure 9A:
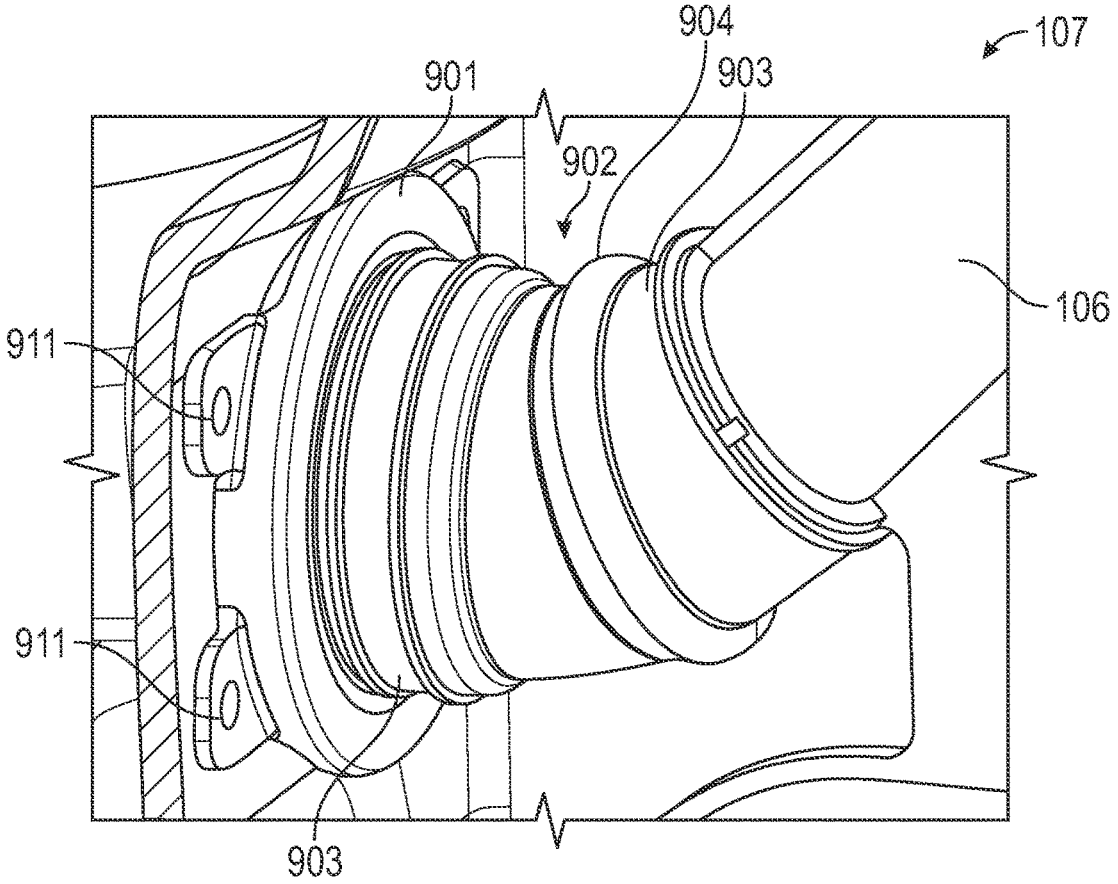
FIG. 9*a*, FIG. 9*b*, and FIG. 9*c* show views of a sump connection of FIG. 1, according to an embodiment.
Figure 9B:
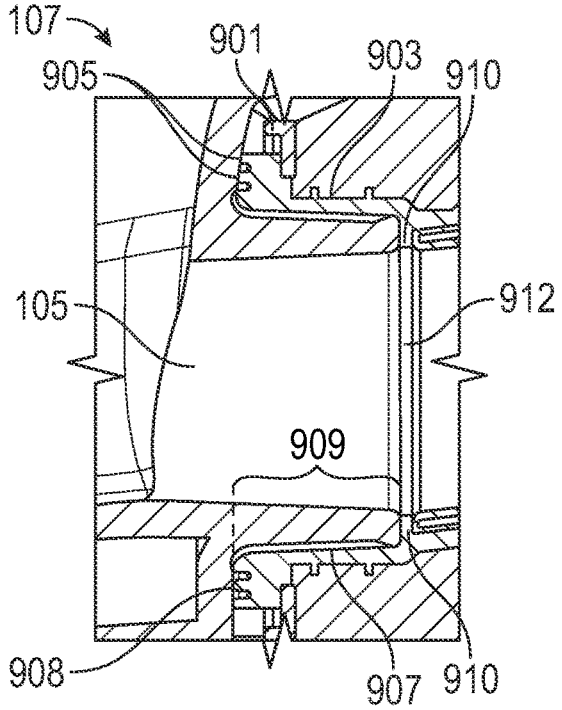
Figure 9C:
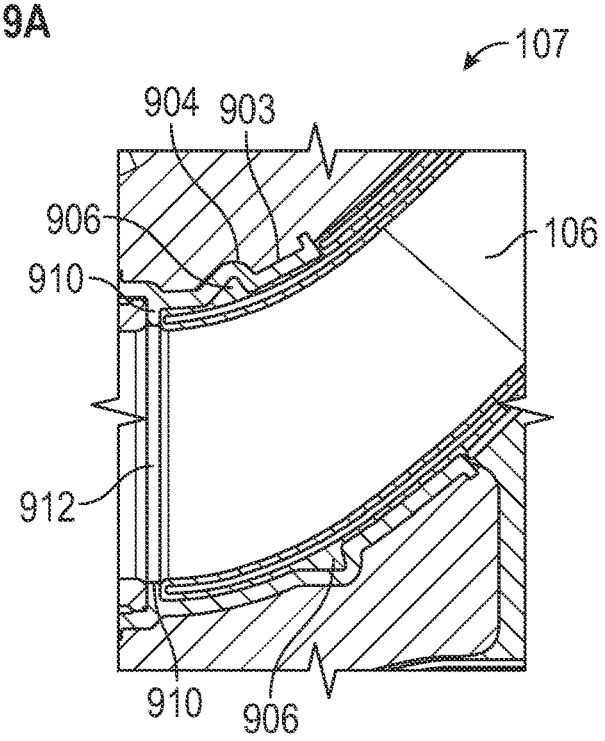

FIG. 9*a*, FIG. 9*b*, and FIG. 9*c* provide views of sump connection 107 of FIG. 1. FIG. 9*b* and FIG. 9*c* are partial cross-section views. Sump connection 107 comprises flange 901 and flexible sleeve 902. Flexible sleeve 902 comprises one or more surfaces 903 configured to receive a metal clamp (hose clamp or worm-drive clamp), radial concave portion 904, and radial protrusions 905. Radial concave portion 904 is configured to receive radial convex portion 906 of trapway 106. Concave portion 904 is concave on the sleeve interior and convex on the sleeve exterior. Flexible sleeve 902 forms primary seal 907 and secondary seal 908 on sump outlet 105. Sump outlet 105 extends about 42 mm, the outlet extension labelled as 909. Sleeve 902 also comprises elastic rib 910 encircling flexible joint 912. Flange 901 is configured to be coupled to a toilet bowl via anchor bolts (not shown) in mounting holes 911 on each side of the flange.

Figure 10A:
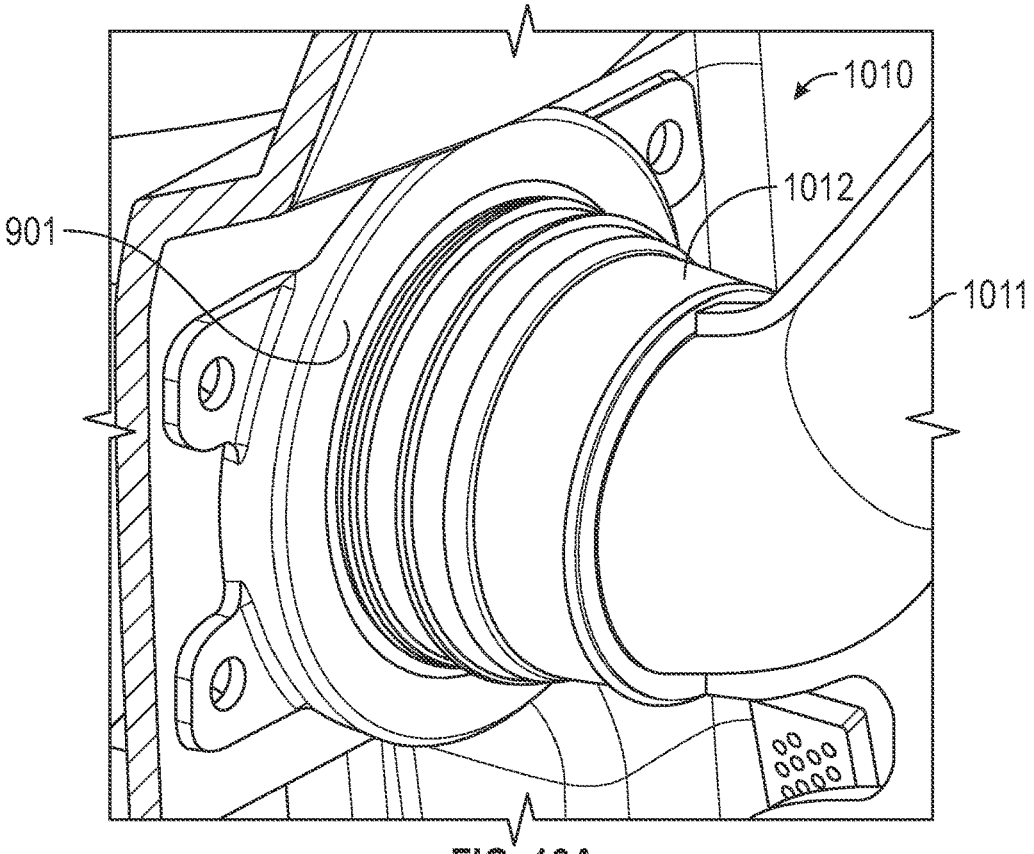
FIG. 10*a* and FIG. 10*b* depict a sump connection, according to an embodiment
Figure 10B:
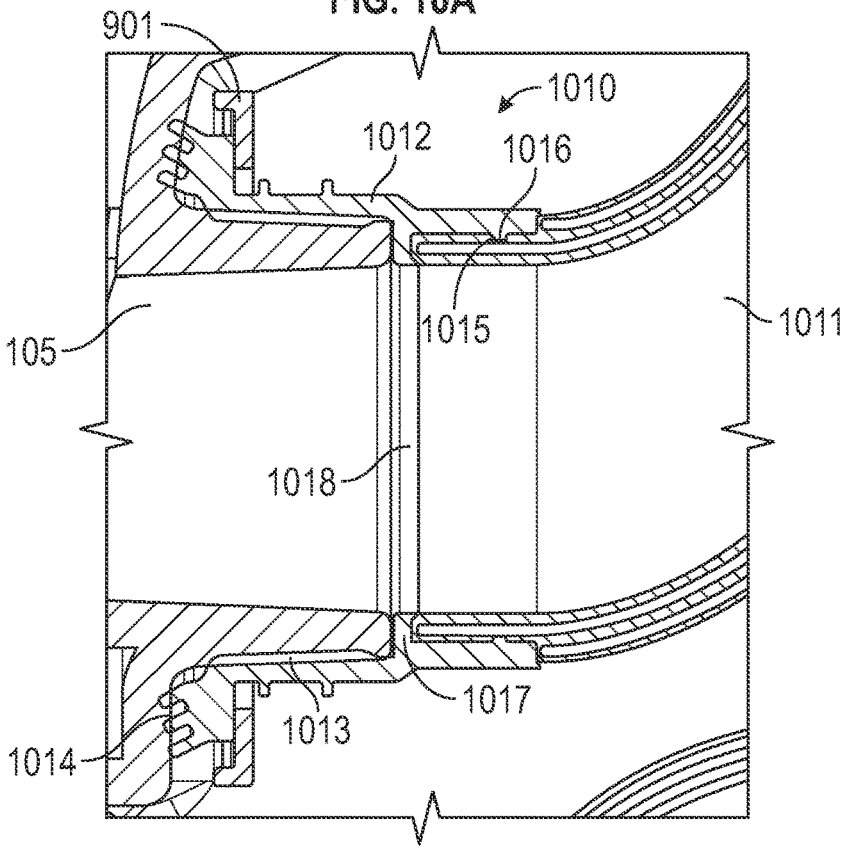

FIG. 10*a* and FIG. 10*b* depict sump connection 1010, according to another embodiment. Trapway 1011 is coupled to sump outlet 105 via overmolded flexible sleeve 1012. In an overmolding process, a trapway is placed in a mold and elastic material is injected into the mold to form a flexible sleeve on the trapway and to chemically integrate the sleeve on the trapway. Sump connection 1010 comprises flange 901, primary seal 1013, and secondary seal 1014. Sleeve 1012 contains radial convex portion 1016 which mates with radial concave portion 1015 of trapway 1011. Sump connection 1010 comprises rib 1017 encircling flexible joint 1018.

Figure 11A:
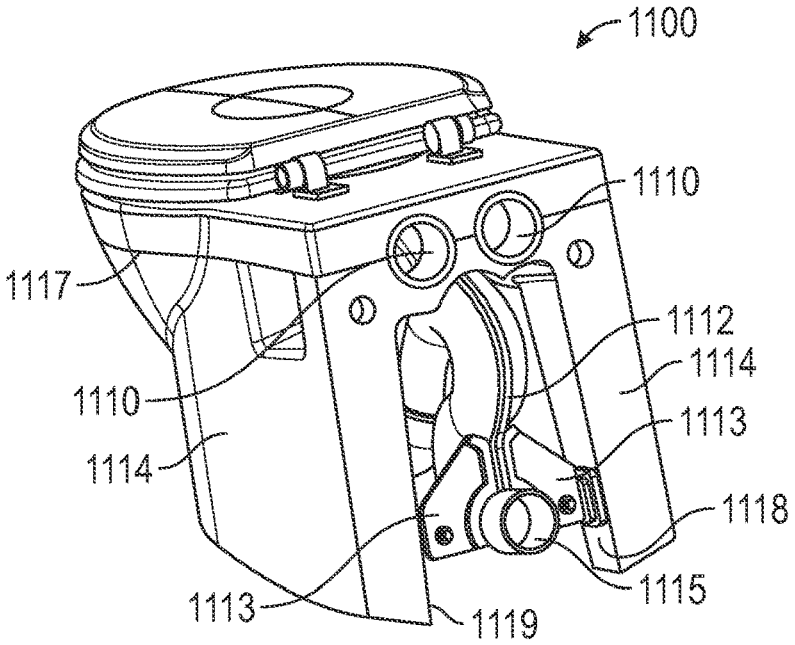
FIG. 11*a* and FIG. 11*b* show a skirted in-wall tank toilet assembly, according to an embodiment.
Figure 11B:
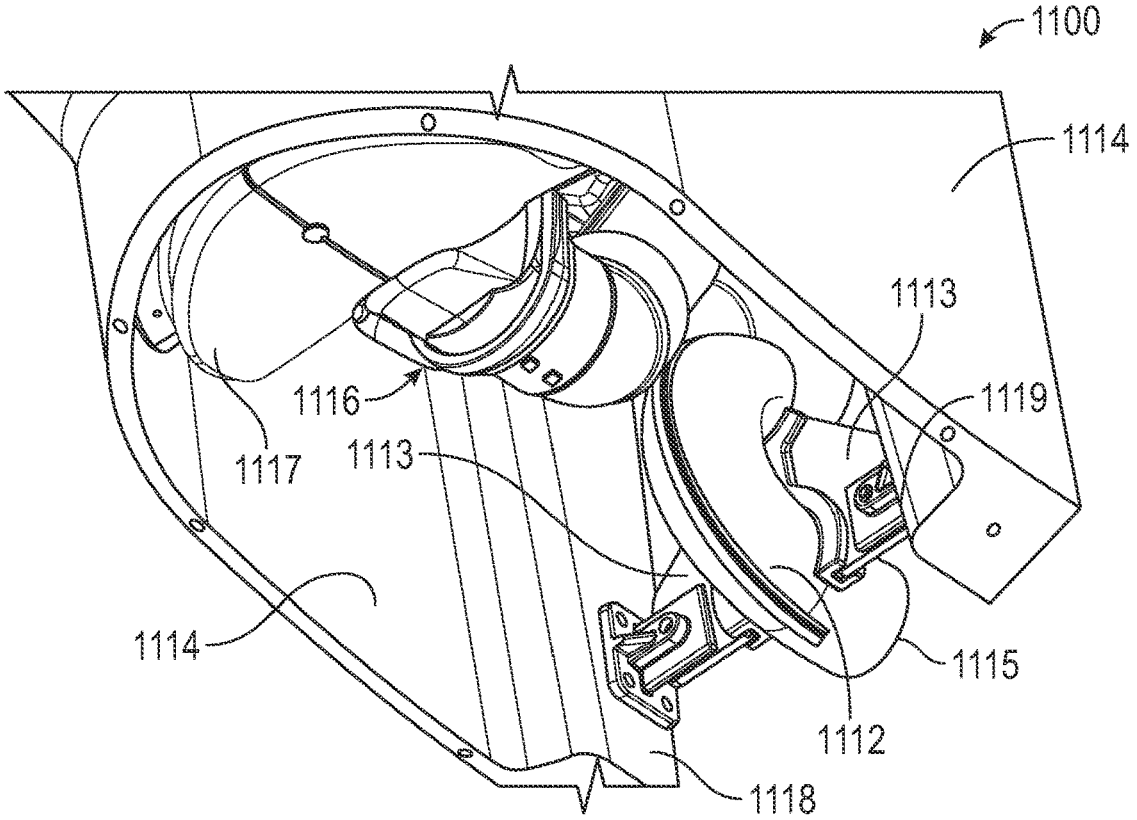

FIG. 11*a* and FIG. 11*b* show a skirted in-wall tank toilet assembly 1100 from the rear and underside, according to an embodiment (in-wall tank not shown). Toilet assembly 1100 contains rim and jet channel inlets 1110 and 1111. Assembly 1100 includes concealed trapway 1112 coupled to bridge 1113. Bridge 1113 is coupled to wall 1114. Toilet assembly 1100 is configured to be wall-mounted and coupled to a toilet tank (not shown) in the wall. Trapway outlet 1115 is configured to couple to a sewer outlet in a wall. Visible is sump connection 1116, which couples trapway 1112 to toilet bowl 1117. Bridge 1113 couples wall 1114 via rear edge 1118 and rear edge 1119.

Figure 12A:
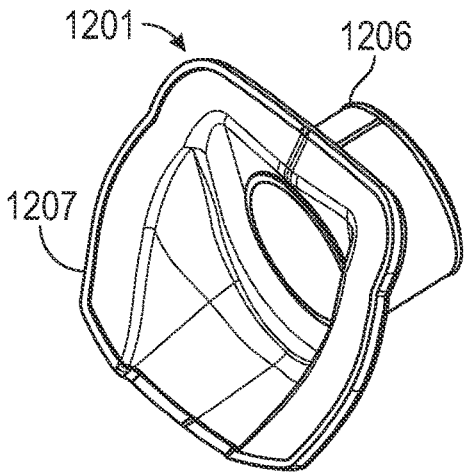
FIG. 12*a*, FIG. 12*b*, and FIG. 12*c* show a sump outlet adapter and a sump connection comprising the adapter, according to an embodiment.
Figure 12B:
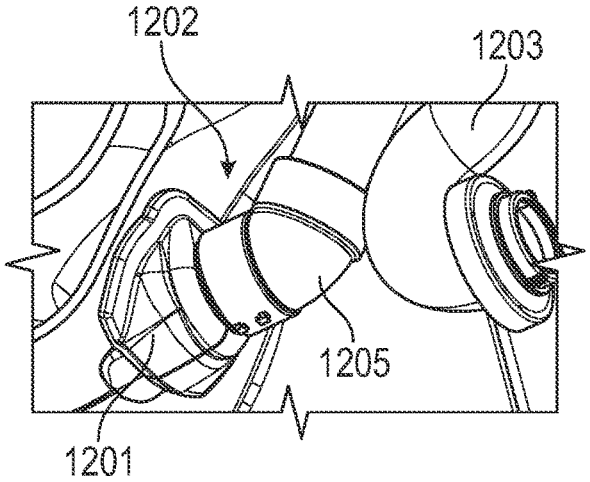
Figure 12C:
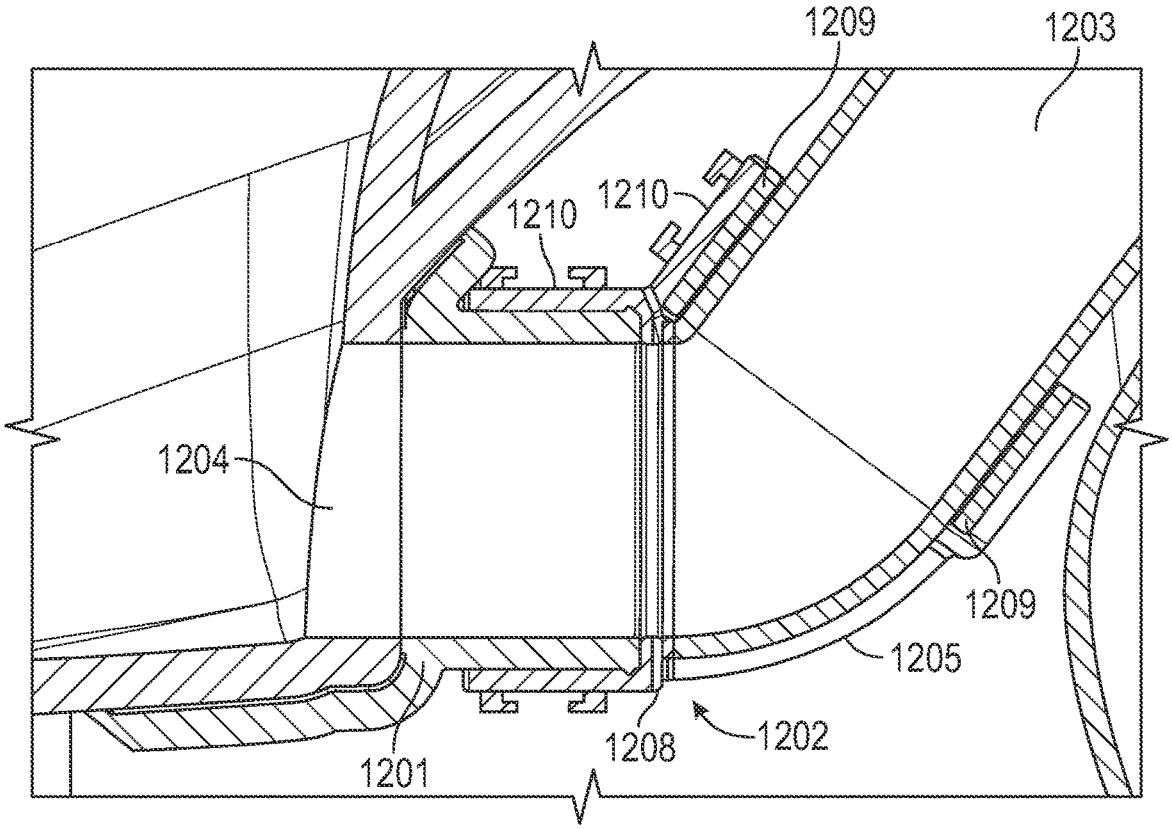

FIG. 12*a* shows a sump outlet adapter 1201, and FIG. 12*b* and FIG. 12*c* show sump connection 1202 comprising adapter 1201, according to an embodiment. FIG. 12*c* shows a cross-section view. Adapter 1201 may comprise a plastic. Sump connection 1202 couples trapway 1203 to sump outlet 1204 via adapter 1201. Adapter 1201 comprises a radial raised edge 1206, configured to mate with a radial concave section on flexible sleeve 1205. Adapter 1201 comprises a pocket 1207 on an edge thereof, configured to receive an adhesive for attaching the adapter to sump outlet 1204. Connection 1202 comprises flexible joint 1208 and radial reinforcement ring 1209. Ring 1209, adapter 1201, and trapway 1203 may comprise CPVC. Sleeve 1205 contains features 1210 configured to receive a hose clamp.

Figure 13A:
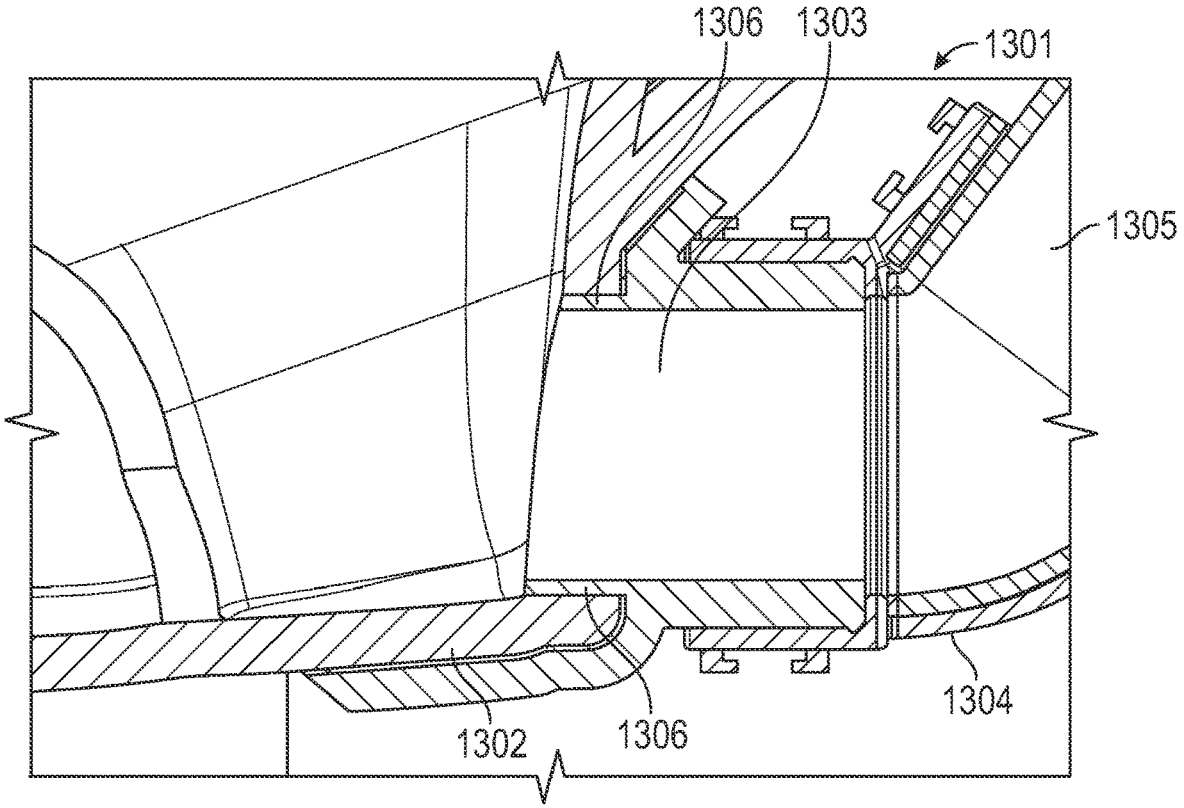
FIG. 13*a* and FIG. 13*b* show a sump connection comprising a sump outlet adapter, according to certain embodiments.

FIG. 13*a* shows sump connection 1301 in cross-section view, according to an embodiment. Sump connection 1301 comprises sump outlet 1302, sump outlet adapter 1303, flexible sleeve 1304, and trapway 1305. Sump outlet adapter 1303 comprises a radial sleeve section 1306 configured to mate with sump outlet 1302.

Figure 13B:
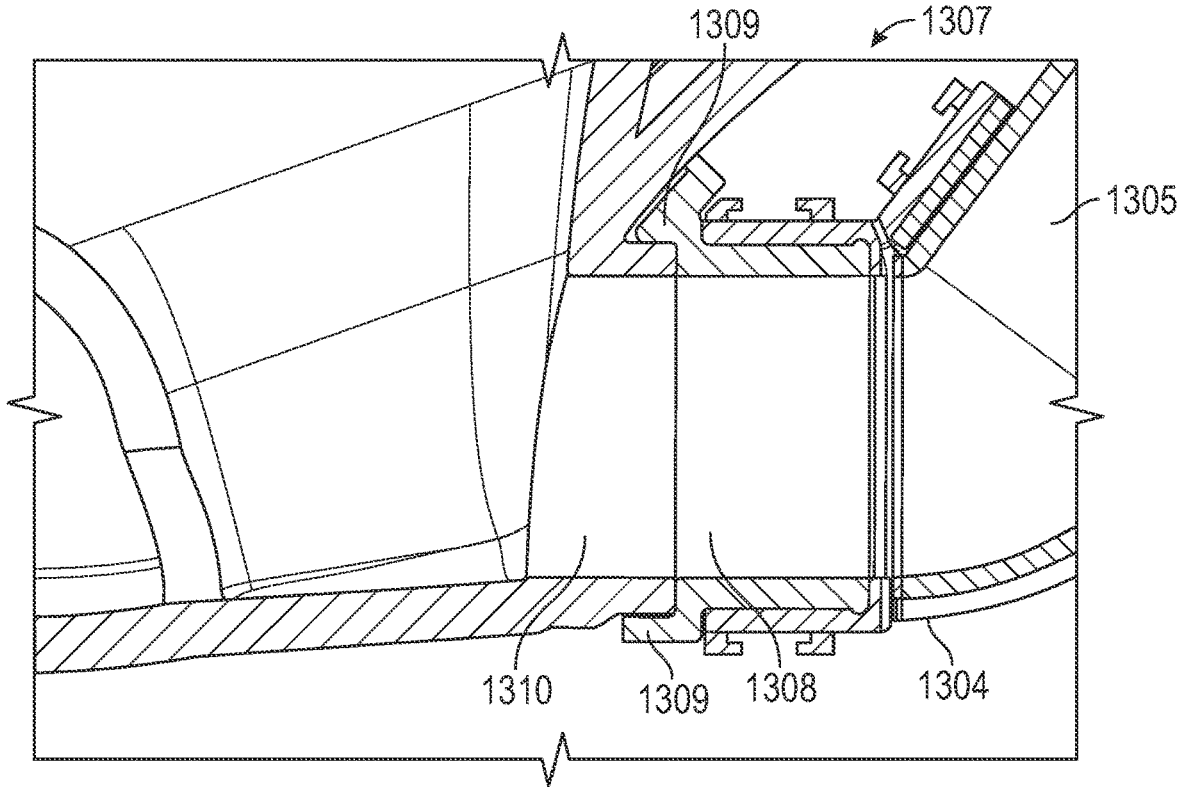

FIG. 13*b* shows a cross-section view of sump connection 1307, according to another embodiment. Sump outlet adapter 1308 contains an enlarged portion 1309 configured for receiving and mating with sump outlet 1310.

Figure 14:
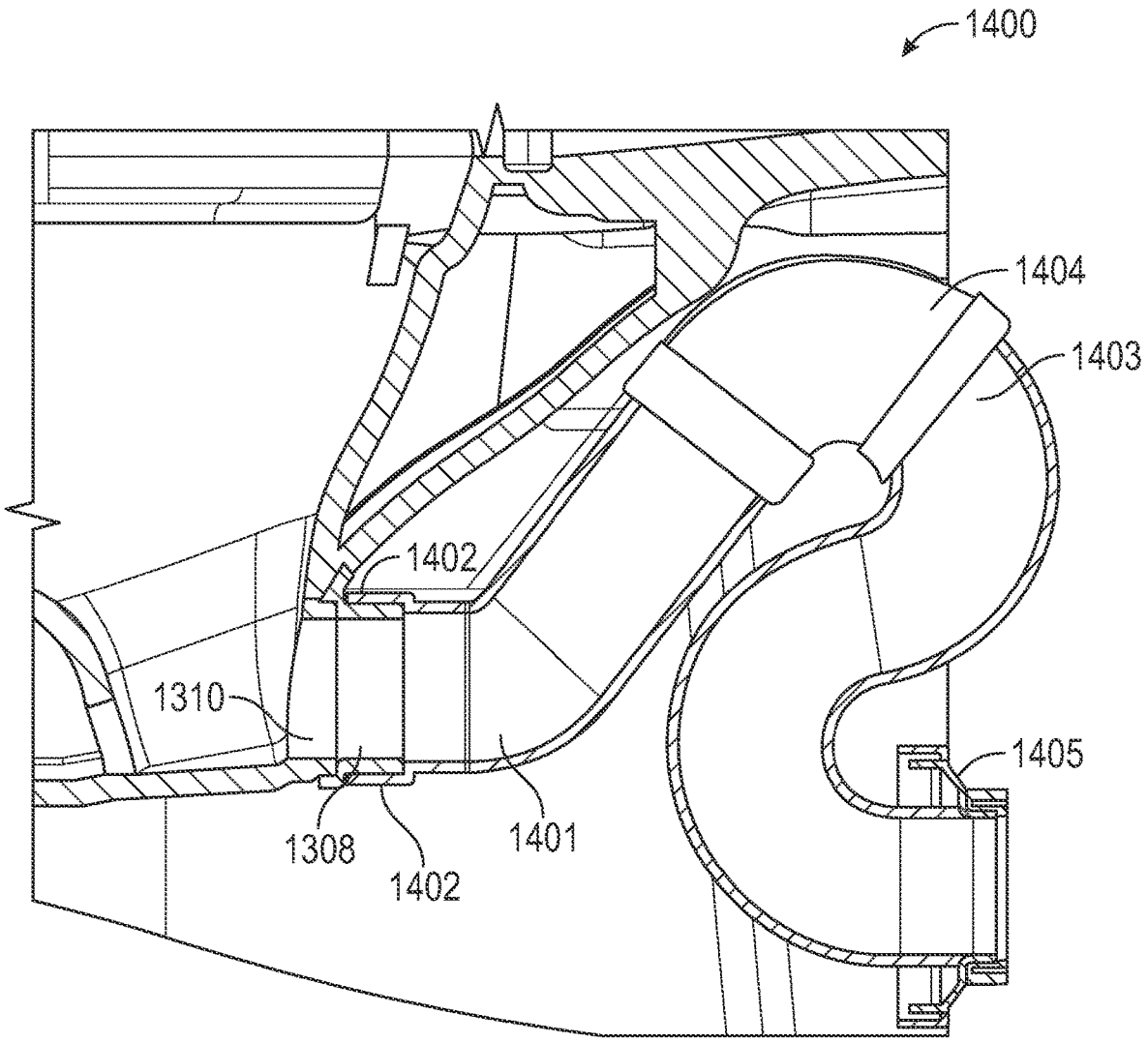
FIG. 14 shows a cross-section view of a toilet assembly, according to an embodiment.

FIG. 14 shows a cross-section view of toilet assembly 1400, according to an embodiment. Sump outlet adapter 1308 is in adherence to sump outlet 1310. Trapway portion 1401 is solvent bonded to outlet adapter 1308 via radial enlarged portion 1402. Trapway portion 1401 is joined to trapway portion 1403 with flexible sleeve 1404. A joint (not visible) between portions 1401 and 1403 is not subject to standing water. Outlet sleeve 1405 is mounted to wall and coupled to sewer drain in the wall. Outlet sleeve 1405 is configured to receive trapway 1403.

Figure 15A:
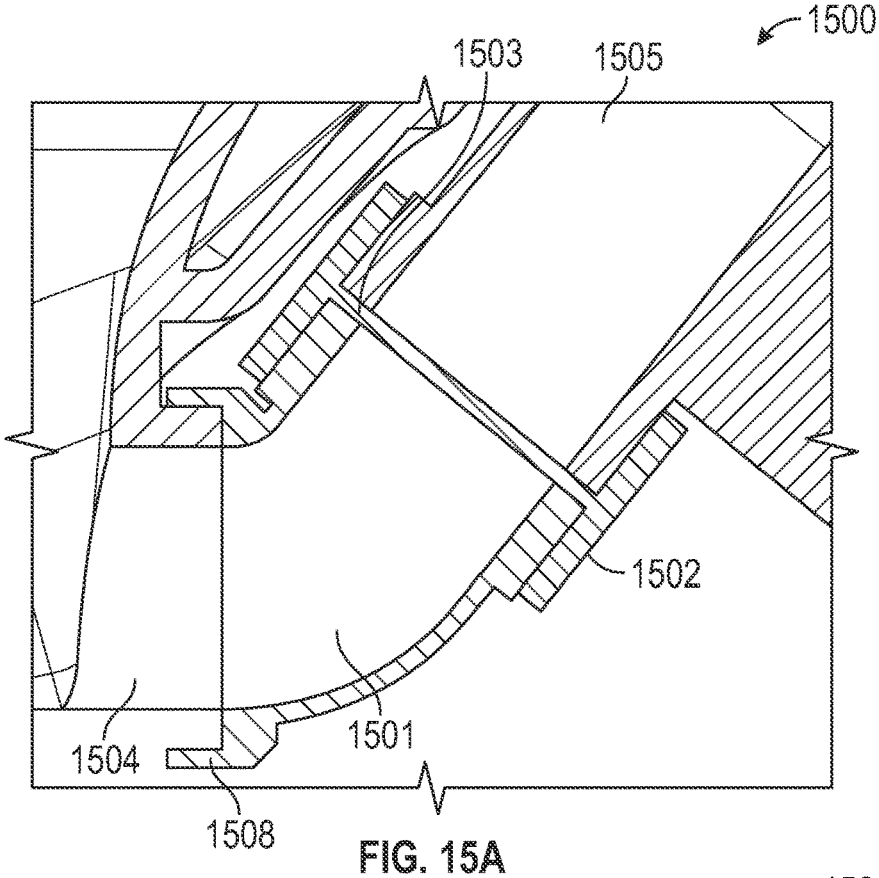
FIG. 15*a* and FIG. 15*b* show a cross-section view and a side view of a sump connection, according to an embodiment.
Figure 15B:
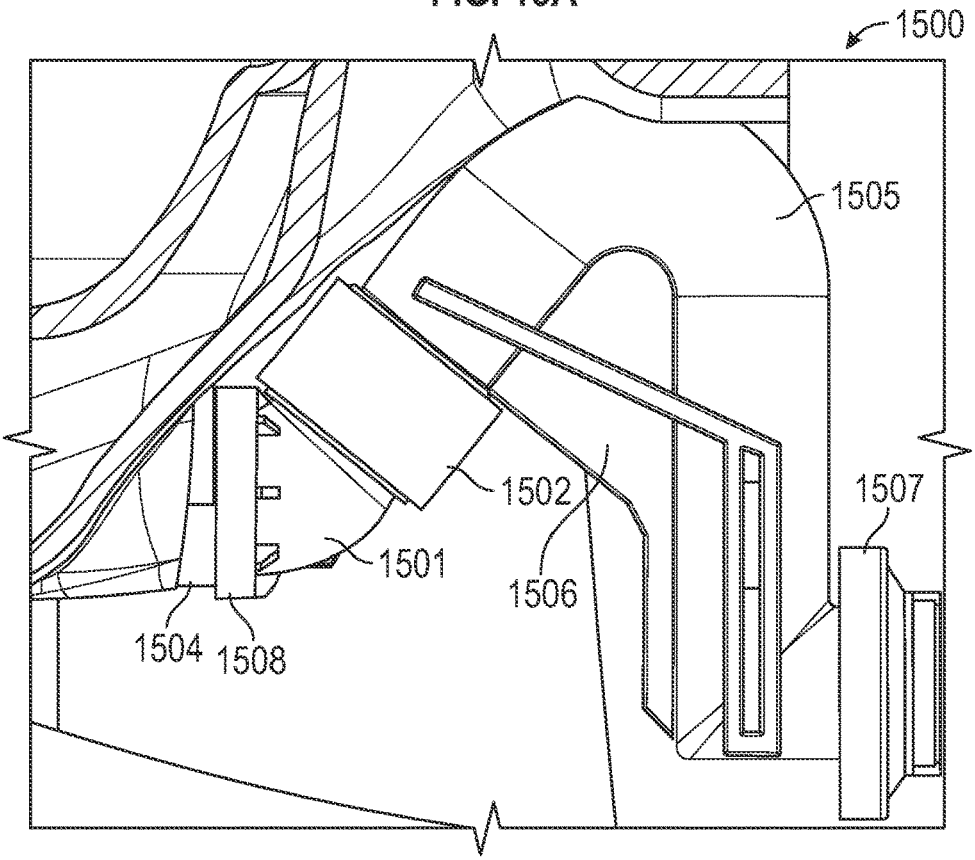

FIG. 15*a* and FIG. 15*b* show a cross-section view and a side-view of another sump connection 1500, according to an embodiment. Sump connection 1500 contains an angled sump outlet adapter 1501 coupled to sump outlet 1504. Angled sump outlet adapter 1501 is coupled to flexible sleeve 1502 and trapway 1505. Trapway 1505 comprises support arm 1506 and is coupled to outlet sleeve 1507 which is configured to couple to a sewer outlet in a wall. A coupling of trapway 1505 to sump outlet adapter 1501 comprises flexible joint 1503. Flexible sleeve 1502 may receive a hose clamp towards either end. Sump outlet adapter 1501 contains a radial enlarged portion 1508 configured to mate with and receive sump outlet 1504.

Figure 16:
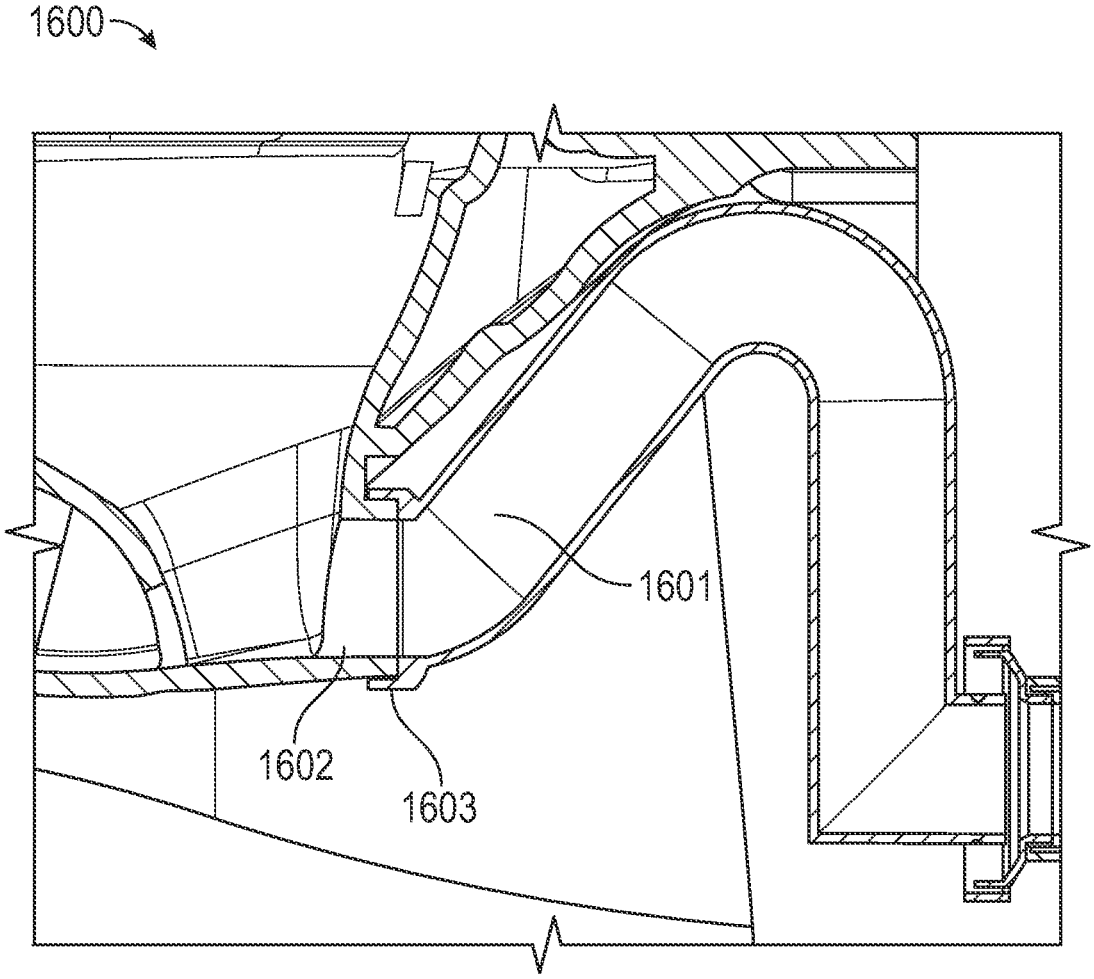
FIG. 16 depicts a sump connection, according to an embodiment.

FIG. 16 shows a cross-section view of another sump connection 1600, according to an embodiment. Trapway 1601 is directly coupled to sump outlet 1602. Trapway 1601 contains radial enlarged portion 1603 configured to receive and mate with sump outlet 1602. Radial enlarged portion 1603 couples to a ring-like portion of sump outlet 1602.

Figure 17:
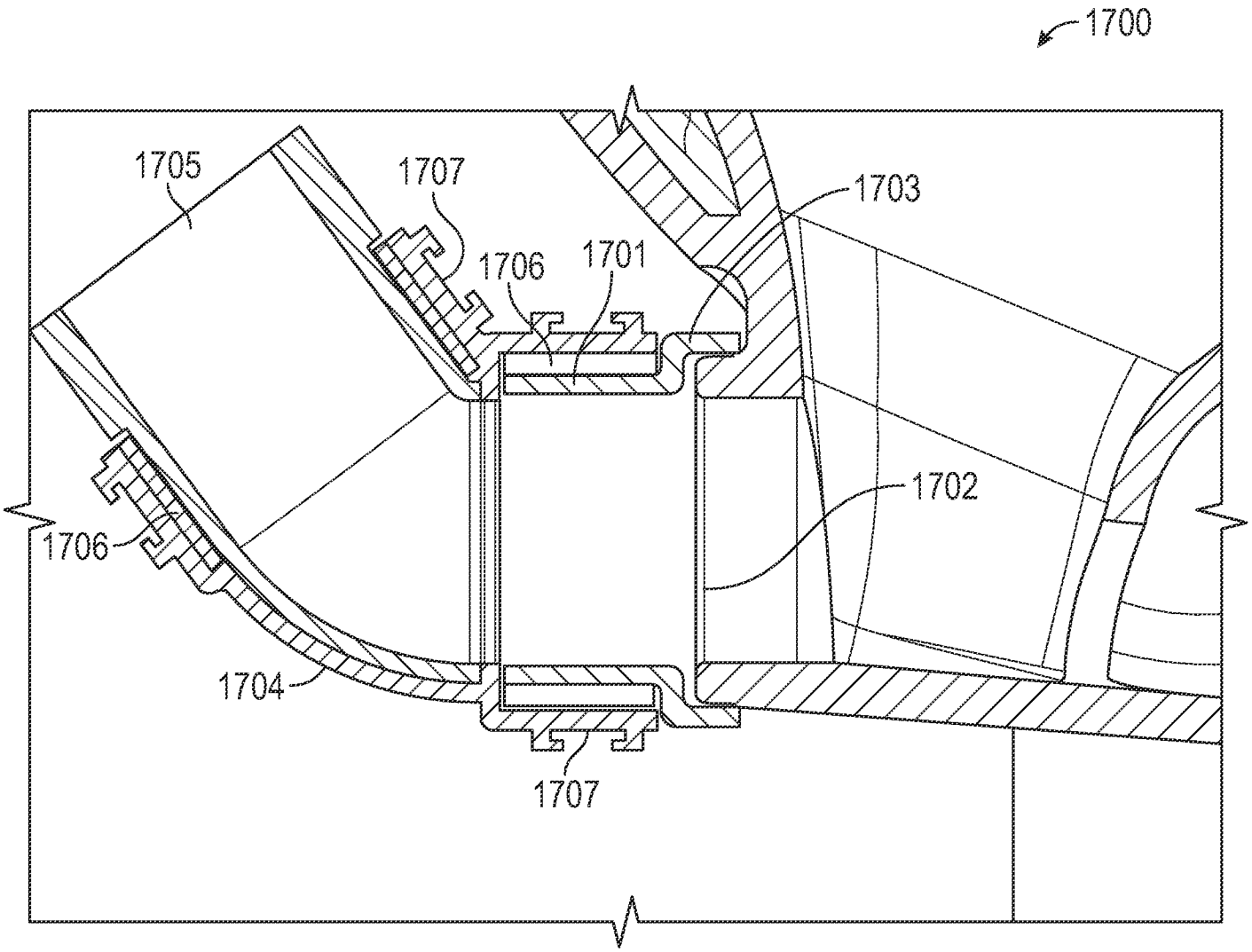
FIG. 17 shows a sump connection, according to an embodiment.

FIG. 17 shows a cross-section view of sump connection 1700, according to an embodiment. Straight sump outlet adapter 1701 containing radial enlarged portion 1703 is connected to sump outlet 1702 via an adhesive. Sump outlet 1702 extends substantially horizontally out from the toilet. Curved flexible sleeve 1704 joins trapway 1705 to adapter 1701. Plastic reinforcement rings 1706 are positioned under sections 1707 configured to receive hose clamps. Radial enlarged portion 1703 is coupled to a ring-like portion of sump outlet 1702. In some embodiments, sump connection 1700 may be suitable for a floor mounted toilet.

Figure 18:
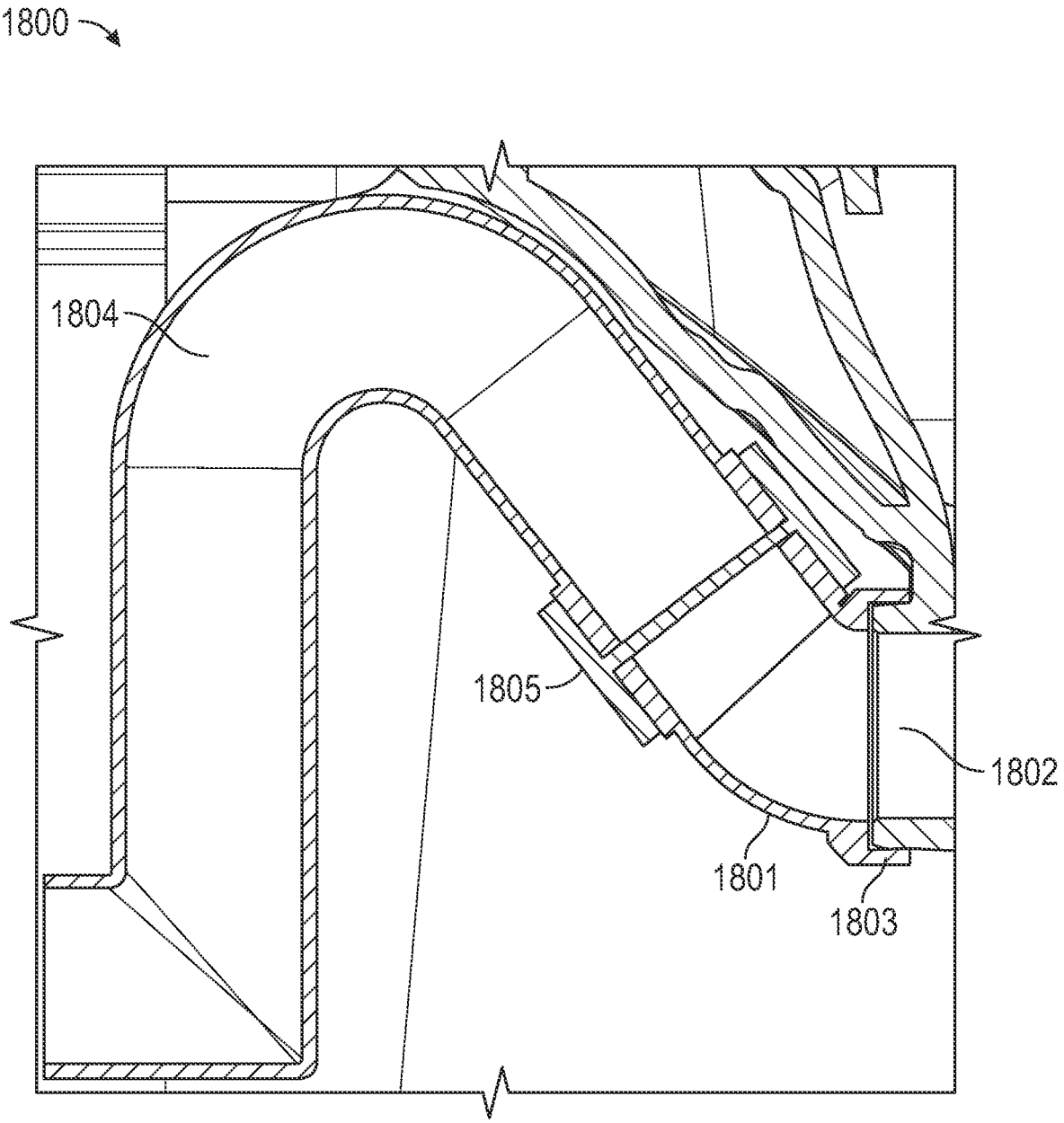
FIG. 18 shows a sump connection, according to an embodiment.

FIG. 18 shows a cross-section view of sump connection 1800, according to an embodiment. Curved sump outlet adapter 1801 containing radial enlarged portion 1803 is connected to sump outlet 1802 via an adhesive. Sump outlet 1802 extends substantially horizontally out from the toilet. Trapway 1804 is joined to adapter 1801 via straight flexible sleeve 1805. Flexible sleeve 1805 may be secured with one or more hose clamps. Radial enlarged portion 1803 couples to a ring-like extending portion of sump outlet 1802. In some embodiments, sump connection 1800 may be suitable for a wall mounted toilet.

Figure 19:
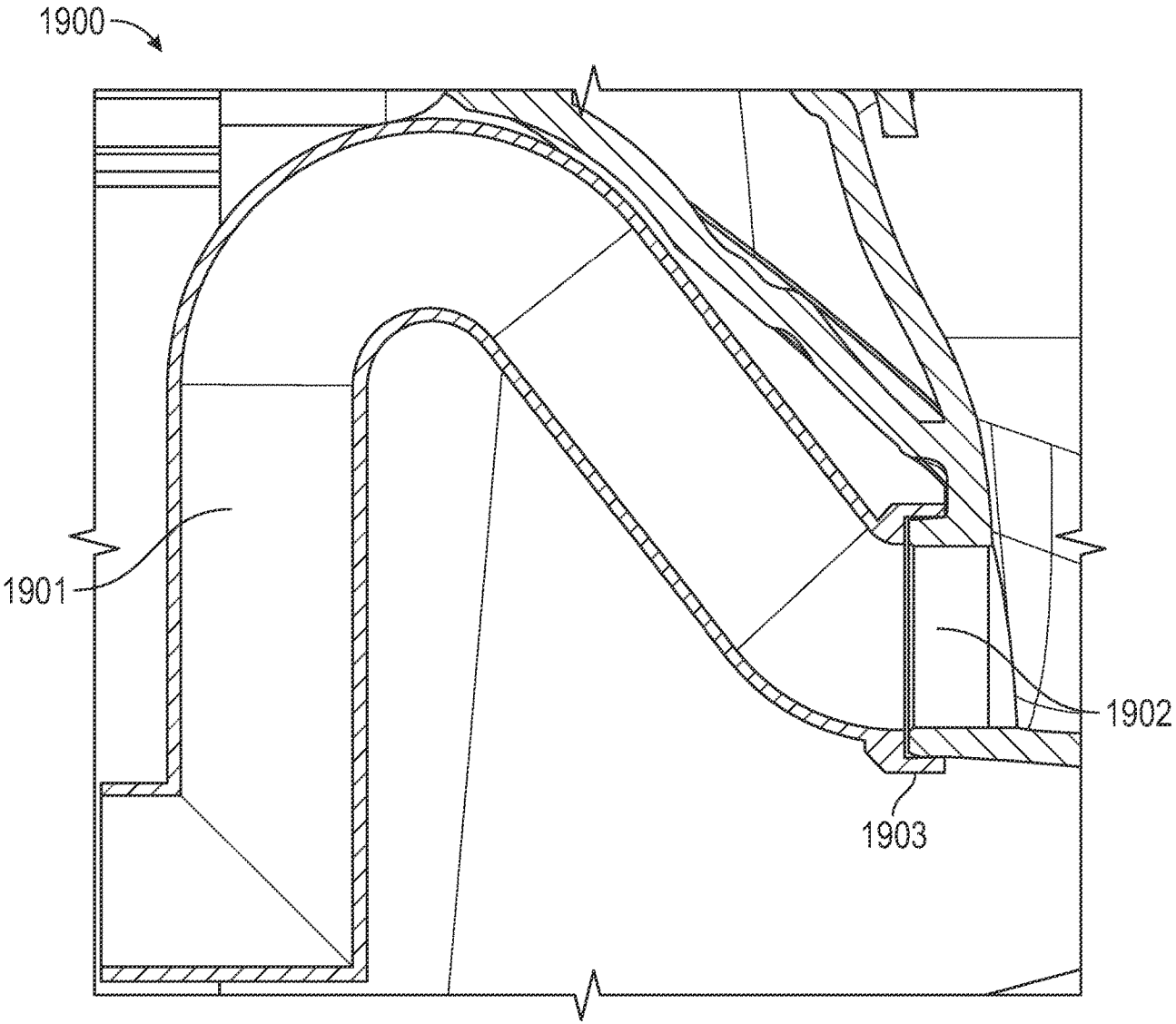
FIG. 19 shows a sump connection, according to an embodiment.

FIG. 19 shows a cross-section view of sump connection 1900, according to an embodiment. Plastic trapway 1901 is joined with sump outlet 1902 via an adhesive. Trapway 1901 comprises radial enlarged portion 1903 configured to mate with sump outlet 1902. Radial enlarged portion 1903 is coupled to a ring-like portion of sump outlet 1902. In some embodiments, sump connection 1900 may be suitable for both wall and floor mounted toilets.

FIG. 20*a*, FIG. 20*b*, FIG. 20*c*, and FIG. 20*d* show various views of a drain connection 2000 for a floor mounted toilet, according to an embodiment. Drain connection 2000 contains flange 2002 and flexible gasket 2003. Gasket 2003 is configured to receive trapway 2001.

Figure 20A:
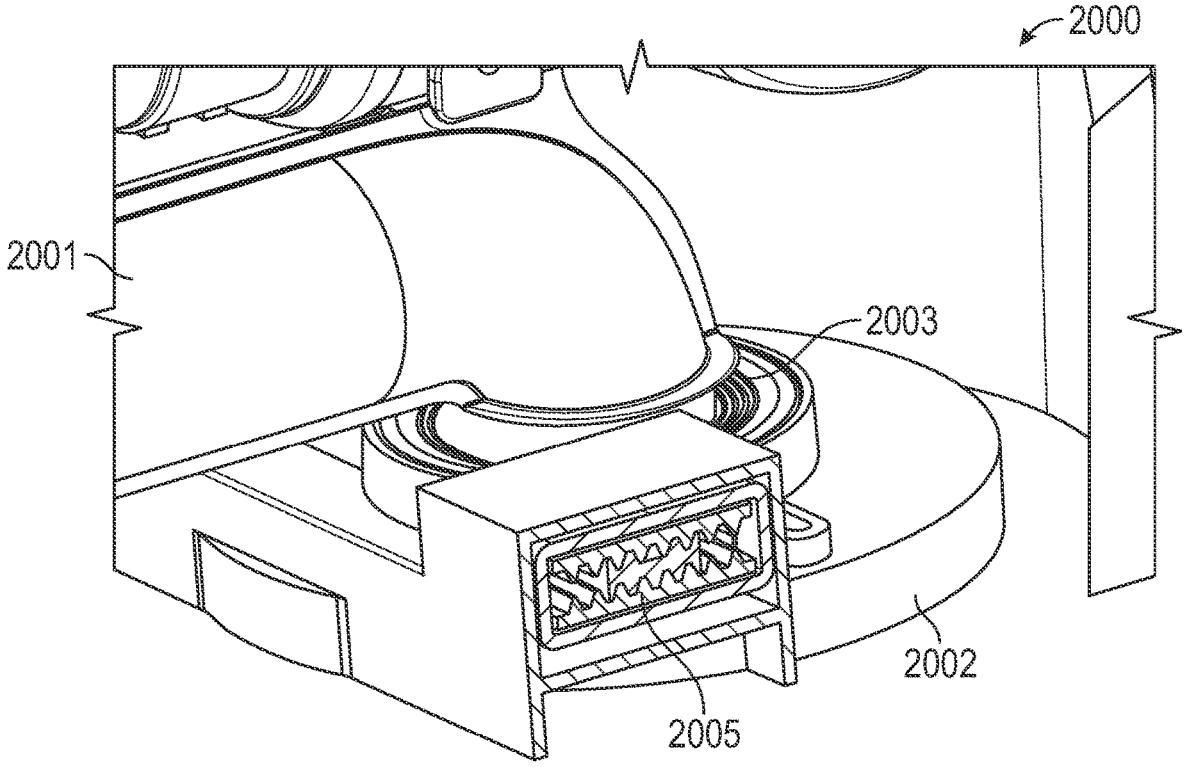
FIG. 20*a*, FIG. 20*b*, FIG. 20*c*, and FIG. 20*d* depict a drain connection, according to an embodiment.
Figure 20B:
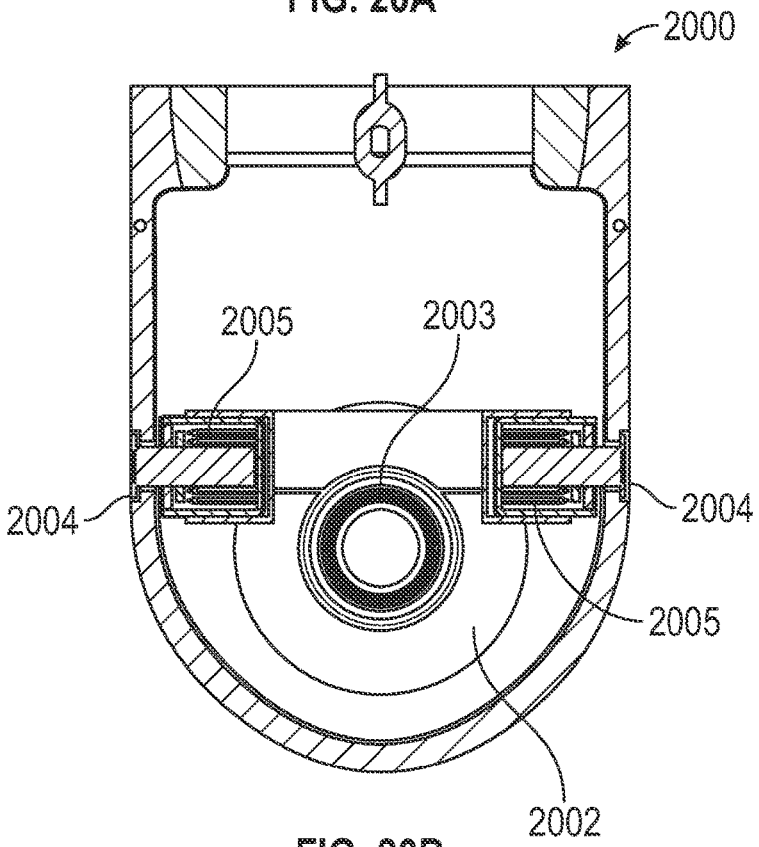
Figure 20C:
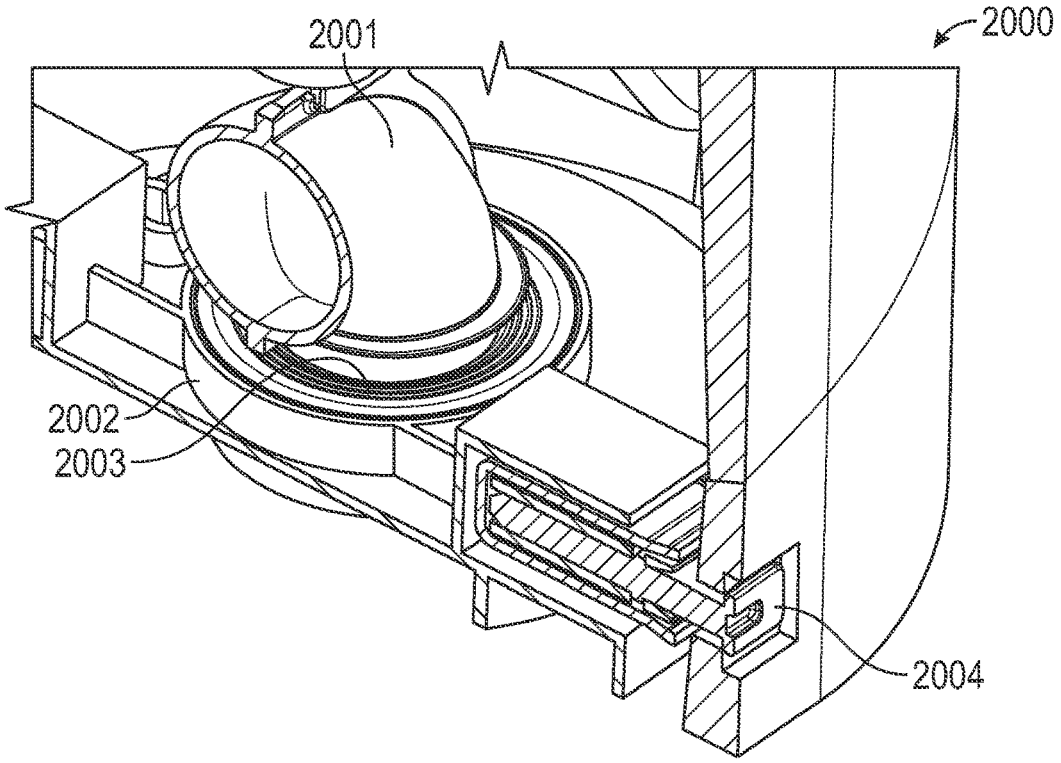
Figure 20D:
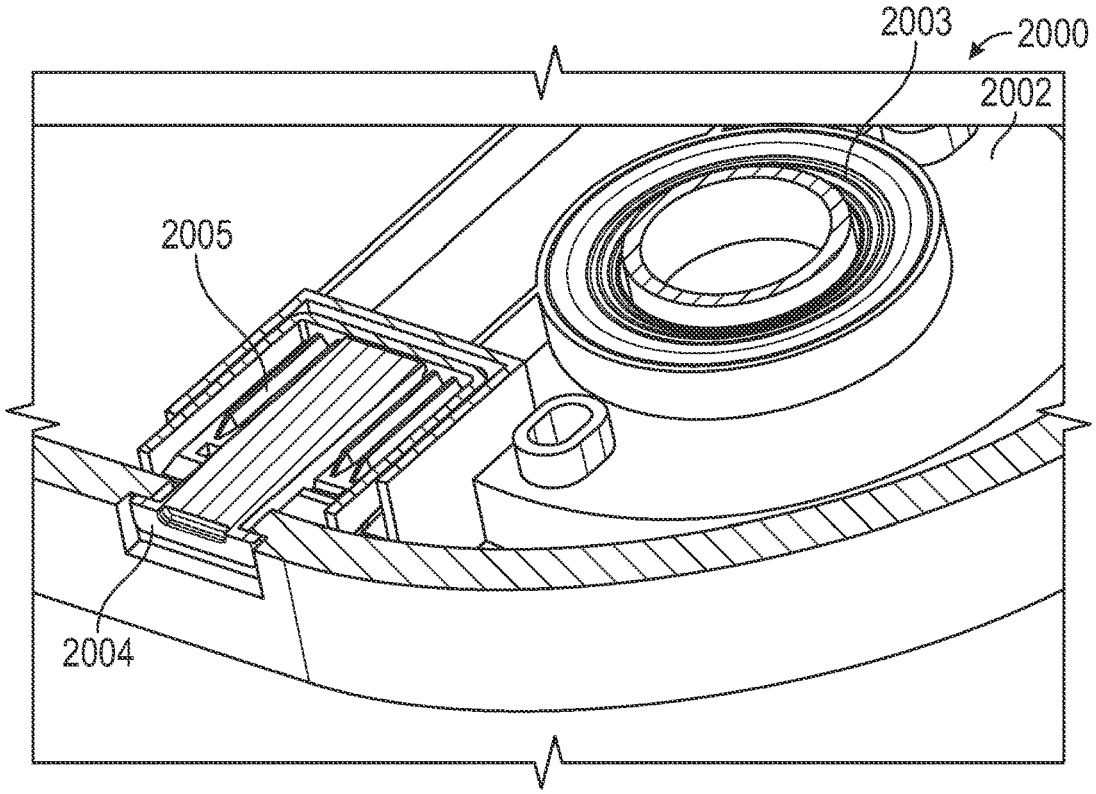

Drain connection 2000 comprises plug adapters 2004 configured to couple to a feature comprising spaced raised ridges 2005. Plug adapters 2004 comprise complimentary slots configured to receive raised ridges 2005, as shown in FIG. 20*a*. As slots and raised ridges 2005 are spaced apart, a degree of freedom is provided from a toilet front to back regarding coupling it and a trapway to a drain connection. Plug adapters may be simply pushed in by hand, or may be driven in with a tool or a separate feature, for instance a screw driver and/or a screw. Plug adapters may be covered with a cap.

Disclosed is a floor mount system for a skirted toilet assembly, the system comprising a drain connection comprising spaced raised ridges configured to receive and couple with a plug adapter. A plug adapter is configured to couple to the spaced raised ridges via an exterior of a toilet assembly wall. The spaced raised ridges provide a degree of freedom regarding placement of the toilet assembly from front to back. The plug adapter couples a toilet assembly to a drain connection assembly. In some embodiments, the raised ridges may comprise a sharp angle top edge and may be triangle-shaped viewed in cross-section. In some embodiments, a distance from one raised ridge to another may be from any of about 1 mm, about 2 mm, or about 3 mm, to any of about 4 mm, about 5 mm, about 6 mm, or about 7 mm, or more. In some embodiments, the raised ridges are substantially evenly spaced. In some embodiments, a feature may comprise from any of about 4 raised ridges, about 5 raised ridges, about 6 raised ridges, or about 7 raised ridges, to any of about 8 raised ridges, about 9 raised ridges, about 10 raised ridges, about 11 raised ridges, about 12 raised ridges, or more.

Some in-wall toilets are described for example in U.S. app. No. 62/839,813, filed Apr. 29, 2019. Some skirted toilets are described for instance in U.S. app. No. 62/795491, filed Jan. 22, 2019, 62/730,862, filed Sep. 13, 2018, and 62/725,640, filed Aug. 31, 2018. In some embodiments, a wall extends around an entire toilet assembly, from a first rear edge to a second rear edge. A wall may form a unitary structure with a toilet bowl. A wall may also support a toilet tank. In other embodiments, a toilet tank may be an "in-wall" tank and separate from a bowl. A wall, a first rear edge, and a second rear edge define an interior space. An interior space is configured to receive and house a trapway. An interior space may also be configured to receive and house a jet channel.

In some embodiments, a toilet assembly may comprise a bridge section, extending from a first rear edge to a second rear edge and coupling the first rear edge to the second rear edge. A bridge may extend from a lower section of a first rear edge to a lower portion of a second rear edge. In other embodiments, a bridge may extend from a central portion of a first rear edge to a central portion of a second rear edge. In other embodiments, a bridge may extend from an upper portion of a first rear edge to an upper portion of a second rear edge.

In some embodiments, a trapway may be coupled to a bridge. Thus, in some embodiments, a trapway may contain a sump connection and a bridge connection. A bridge may have a "recess" or aperture, configured to receive a portion of a trapway. In some embodiments, a bridge recess may be disposed towards a center of the bridge and receive a lower portion or "heel" of a trapway. A heel of a trapway may rest on and be supported by a bridge recess, or, a heel of a trapway may be suspended freely in a bridge recess. A bridge connection is configured to support a trapway. In some embodiments, a trapway may comprise a part configured to mate with and couple to a bridge to form a bridge connection. In some embodiments, a trapway may comprise a flange configured to mate with and couple to a bridge and/or parts (e.g. fixing parts) disposed on a bridge.

In some embodiments, a sump outlet may extend outward from a lower part of a toilet bowl within a space defined by the wall and rear edges. In some embodiments, a sump outlet may extend substantially horizontally outward from a bowl. A sump outlet may extend from any of about 5 mm, about 7 mm, about 9 mm, about 10 mm, about 12 mm, about 14 mm, about 16 mm, about 18 mm, about 20 mm, about 22 mm, about 25 mm, about 30 mm, about 35 mm, about 38 mm, about 40 mm, about 42 mm, about 44 mm, about 46 mm, about 48 mm, about 50 mm, or about 55 mm, to any of about 60 mm, about 65 mm, about 70 mm, about 75 mm, about 80 mm, about 85 mm, about 90 mm, about 95 mm, or about 100 mm, or more from a bowl. An outward extension may be defined as a longest horizontal measure.

In some embodiments, a straight cylindrical portion of a sump outlet adapter may extend, or have a length of, from any of about 10 mm, about 12 mm, about 14 mm, about 16 mm, about 18 mm, about 20 mm, about 22 mm, about 24 mm, about 25 mm, about 27 mm, about 29 mm, about 31 mm, about 33 mm, about 35 mm, about 37 mm, about 39 mm, about 40 mm, about 42 mm, about 44 mm, about 46 mm, or about 48 mm, to any of about 50 mm, about 52 mm, about 57 mm, about 65 mm, about 75 mm, about 85 mm, about 90 mm, about 95 mm, or about 100 mm, or more.

In some embodiments, a sump connection may comprise a sump outlet extending substantially horizontally from the toilet. In some embodiments, a sump outlet may extend from any of about 3 mm, about 5 mm, about 7 mm, about 9 mm, or about 10 mm, to any of about 11 mm, about 12 mm, about 13 mm, about 14 mm, about 15 mm, or about 16 mm, or more from the toilet.

In some embodiments, a portion of a sump outlet extension may be ring-shaped and may be considered an "annular ring" configured to couple to a trapway or a sump outlet adapter.

In some embodiments, a sump connection may comprise a substantially straight, substantially horizontal sump outlet adapter adhesively coupled to a ceramic sump outlet. A plastic trapway may be coupled to the sump outlet adapter via a curved flexible sleeve, one or more reinforcement rings, and one or more hose clamps. In other embodiments, a sump connection may comprise a curved sump outlet adapter adhesively coupled to a ceramic sump outlet. A plastic trapway may be coupled to the sump outlet adapter via a straight flexible sleeve, one or more reinforcement rings, and one or more hose clamps.

In some embodiments, a flexible joint may have a width (thickness between elements joined) of from any of about 1.2 mm, about 1.4 mm, about 1.6 mm, about 1.8 mm, about 2.0 mm, about 2.2 mm, about 2.4 mm, about 2.6 mm, or about 2.8 mm, to any of about 3.0 mm, about 3.2 mm, about 3.4 mm, about 3.6 mm, about 3.8 mm, about 4.0 mm, about 4.2 mm, about 4.4 mm, about 4.6 mm, about 4.8 mm, about 5.0 mm, about 5.2 mm, about 5.4 mm, about 5.6 mm, about 5.8 mm, about 6.0 mm, about 6.2 mm, about 6.4 mm, about 6.6 mm, about 6.8 mm, about 7.0 mm, about 7.2 mm, or more.

In some embodiments, a flexible joint may comprise a flexible radial protrusion or radial ring, which may be a unitary part of a flexible sleeve or may be a separate part.

In some embodiments, a flexible sleeve may have a thickness of from any of about 1.2 mm, about 1.4 mm, about 1.6 mm, about 1.8 mm, about 2.0 mm, about 2.2 mm, about 2.4 mm, about 2.6 mm, or about 2.8 mm, to any of about 3.0 mm, about 3.2 mm, about 3.4 mm, about 3.6 mm, about 3.8 mm, about 4.0 mm, about 4.2 mm, about 4.4 mm, about 4.6 mm, about 4.8 mm, about 5.0 mm, about 5.2 mm, about 5.4 mm, about 5.6 mm, about 5.8 mm, about 6.0 mm, about 6.2 mm, about 6.4 mm, about 6.6 mm, about 6.8 mm, about 7.0 mm, about 7.2 mm, or more. In some embodiments, a flexible sleeve thickness may be thicker than a flexible joint width, for instance from any of about 0.4 mm, about 0.5 mm, about 0.6 mm, about 0.7 mm, about 0.8 mm, or about 0.9 mm, to any of about 1.0 mm, about 1.1 mm, about 1.2 mm, about 1.3 mm, about 1.4 mm, about 1.5 mm, about 1.6 mm, about 1.7 mm, about 1.8 mm, about 1.9 mm, about 2.0 mm, or more.

In some embodiments, a trapway and a toilet (e.g. bowl, wall, sump outlet) comprise dissimilar materials. A trapway may comprise or consist essentially of thermoplastic (plastic) materials. A toilet may consist essentially of a ceramic material.

In some embodiments, trapways described herein may comprise one or more of polyvinyl chloride (PVC), schedule 40 PVC, chlorinated PVC (CPVC), polypropylene (PP), polypropylene with glass fiber (PP+GF), polypropylene with talc (PP+TD, high density polyethylene (HDPE), other polyolefins, a polystyrene, a polyester, or a polyamide. Polystyrenes include copolymers including ABS (acrylonitile-butadiene-styrene copolymer). A sump outlet adapter or other plastic part of a connection may also comprise one of these plastics, which may be the same or different than that of a trapway.

Connections and/or sleeves described herein may comprise ethylene propylene diene terpolymer rubber (EPDM), chloroprene rubber (CR), or other rubber. Ranges described herein may comprise plastic and/or metal. Clamps described herein may be metal. Fasteners described herein may comprise metal and/or plastic.

In some embodiments, a sump connection couples a trapway to a sump outlet via a primary seal and a second seal. That is, a sump connection may comprise a primary seal and a secondary seal. A primary seal is generally a seal formed by a sump connection element and a lateral (horizontal) portion of a sump outlet. A secondary seal is generally a seal formed by a sump connection element and another portion of a sump outlet, for instance a substantially vertical portion of a sump outlet.

In some embodiments, a sump connection may comprise a flexible sleeve. A flexible sleeve may be overmolded on a trapway. An overmolding process may comprise placing a trapway in a mold and injecting flexible sleeve material (e.g. a rubber) into the mold to form an integrated flexible sleeve/trapway part. In other embodiments, a trapway and a flexible sleeve may be employed as individual parts to prepare a sump connection.

In some embodiments, a sump connection may comprise a sump outlet adapter. A sump outlet adapter may comprise a same or similar plastic as that of a trapway, or may comprise a different plastic. In some embodiments, a sump outlet adapter may comprise a section configured to receive an adhesive for forming an adhesive joint with a sump outlet.

In some embodiments, a sump connection may comprise a trapway directly bonded to a sump outlet, for instance via an adhesive joint. A trapway may comprise an enlarged portion configured to receive and couple to a sump outlet. A trapway may comprise one or more pockets or other features configured to receive an adhesive.

According to an embodiment, a chemical bond is formed by applying an adhesive to a sump outlet and/or a trapway, sump outlet adapter or primary or secondary seals. According to an embodiment, an adhesive is one of or a combination of Loctite AA-H5004, Loctite AA-H3300, Loctite EAE-05MR, Loctite EAE-00NS, or Loctite EAE-00CL. According to an embodiment, a chemical bond further comprises an adhesion promoter.

In some embodiments, as a toilet exits a kiln and is cooled to a desired temperature, an adhesion promoter may be applied to an exterior surface of a sump outlet and/or an interior surface of a trapway. After the adhesion promoter is applied, a selected adhesive may be applied to the exterior surface of the sump outlet and/or the interior surface of the trapway. An adhesion promoter and/or an adhesive may be applied to the surfaces desired to be connected or adhesively/chemically bonded.

After an adhesion promoter (which may be optional) and an adhesive are applied to the desired surfaces, a trapway may be moved or slid over a sump outlet or alternatively, a trapway may be moved or slid into a sump outlet. Fixtures, such as static or robotic fixtures found on conventional assembly lines, may hold components in place during an initial setting/curing phase of an adhesive and/or until the adhesive is complete cured.

Residual heat energy from a kiln may speed or quicken the setting/curing time of an adhesive. If a toilet has been allowed to cool to room temperature or if additional energy is desired to be applied to quicken the setting/curing time, a ceramic toilet may be exposed to an energy source, such as microwave or heat sources, that may apply microwave energy or heat, respectively, to a connection to speed the setting/curing time of the connection. Special addition of appropriate energy sources (e.g. heat or microwave) under control setting may decrease fixture time, by allowing a "fast set" segment of an adhesive full curing schedule. This may allow additional assembly processes, while not impacting final performance of an adhesive/chemical bond. A selected energy application should avoid boiling of adhesive base chemicals, providing open cell structure and leak paths, and/or change chemical conversion to less than targeted final molecular structure and rigidity. Energy input, from a kiln as stored heat or induced by a microwave oven may range from about 85° F. to about 140° F. Energy input may accelerate curing of an adhesive, without sacrificing dimensional and physical stability of a plastic trapway or component. An exemplary microwave oven may be a commercial grade Panasonic model NN-T945SFX having an output of 1500 Watts.

A toilet may be allowed to cure completely in a factory. Alternatively, as previously described, a toilet may be allowed to cure past a quick set phase and packaged or secured for shipment/selling to consumers. An adhesive may be allowed to completely cure during or after the toilet is packaged.

Any number of chemistries, adhesion promoters, adhesives, techniques, etc., may be employed to allow for economical and quick time of assembly of a connection between a plastic component and a ceramic component. An adhesion promotor, adhesive, technique, energy applied, length and temperature of energy application, and other factors of a bond may be selected to achieve a connection and seal between a plastic component and a ceramic component. An adhesion promotor, adhesive, technique, energy applied, length and temperature of energy application, and other factors of a bond may be selected to achieve a bond with a long life, for example, greater than about 5 months, greater than about 1 year, about 5 years, about 10 years, or longer. A bond may have a long life even when exposed to constant or near constant water, liquids, or flow of water or liquids. A seal may have a strength or water resistance that allows for the seal to be under constant or near constant water or flows.

Exemplary techniques to achieve a chemical or adhesive bond may include all various thermoplastic materials and thermoset materials, and/or combinations of both. Thermoplastics may include various modifications of plastic welding technologies. For example, solvent bonding, hot gas welding, heat sealing, heat fusion, laser welding, spin welding, ultrasonic welding, high frequency welding, injection welding, and/or induction welding. In some embodiments, a thermoplastic component (e.g. a plastic trapway) may be injection molded directly onto a ceramic toilet bowl.

A plastic component (e.g. a plastic trapway, sump outlet adapter, etc.) may comprise or consist essentially of any thermoplastics such as polypropylene, polyethylene, both of various densities of backbone polymers, co-polymers thereof and blends thereof with other polymers. Thermoplastics may also include polytetrafluoroethylene (PTFE), vinyl, thermoplastic elastomers (TPE), and/or rubbers. Thermoplastic materials include PVC or ABS. Examples of plastics include schedule 80, schedule 40, and/or schedule 40DWV, or combinations there off. Such materials may be defined by standards such as ASTM and ANSI: ASTM D 2104, ASTM D 2661, ATSM D 2665, ATSM D 2729, ASTM D 3965, ASTM F 438, ASTM F 628, ASTM F 891, ASME A112.18.2-2011/CSA B125.2-11, ASME A112.19.2-2013/CSA B45.1-13, CAN/CSA B181.1, CAN/CSA B181.2. One exemplary material may be an ABS plastic pipe as defined by ASTM D 1788. Another exemplary material may be a Schedule 40 PVC pipe as defined by ASTM D 1785.

Exemplary adhesives may include thermoset high performance economical adhesives. Exemplary adhesives may include, but are not limited to epoxies, polyurethanes, polyesters, and silicone. Thermoset adhesives may be applied as direct injection into joint gaps, pre-applied and cured during a reaction period, and/or applied as pre-impregnated forms supplied from rolls or tapes that are cut into shape then cured by heat, microwave or other energy supply method to activate a curing process. When cured, adhesives may provide permanent structure gap filling and sealing connection of ceramic portion of a device to non-ceramic portions.

In certain embodiments, an adhesive may include an epoxy-based adhesive or an acrylic-based adhesive. An adhesive may be one or more of Henkel's Loctite adhesives including acrylic-based adhesives such as AA-H5004, or AA-H3300 or epoxy-based adhesives such as EAE-05MR, EAE-00NS, or EAE-00CL, the technical data sheets of which are hereby incorporated by reference in their entireties.

Adhesion promoters or primers may include silanes or silicones. An adhesion promoter may protect chemical activity before application of an adhesive. In some embodiments, an adhesion promoter is not water soluble and may provide increased water resistance as compared to adhesives alone. One exemplary material is Lord Chemical AP-134, an organically dry solvent based silane adhesion promoter. Lord Chemical AP-134 Adhesion Enhancer/Surface Modifier Lord Technical Data Sheet Is hereby incorporated by reference in its entirety. Without being bound by theory, it is believed use of an adhesion promoter may allow flash off of all solvents and may allow atmospheric moisture or artificially induced moisture to react an organo-silane portion of an adhesion promoter molecule to a glass-like structure portion of ceramic sanitaryware. An adhesion promoter may also provide reactive sites for an organic ending portion of molecules of a selected adhesive. These may couple and cure to provide structural strength with gap filling qualities and water resistance required for long life durability.

In some embodiments, a plastic part, such as a trapway or a sump outlet adapter, may be coupled to a sump outlet in a substantially horizontal manner. That is, a plastic part may have an end that couples to a sump outlet, wherein the sump outlet extends from a bowl substantially horizontally. A plastic part may have a substantially circular cross-section, wherein an end may have an axis that extends through the center of the circular cross-section. The axis may be oriented substantially horizontally (when viewed from the side of a toilet) and/or substantially parallel to the ground surface (when viewed from the side of the toilet). A sump outlet may also have a substantially circular cross-section having an axis that extends through the center of the circular cross-section. A sump axis may be oriented substantially horizontal (when viewed from the side of a toilet) and/or substantially parallel to the ground surface (when viewed from the side of a toilet). When coupled together, a sump axis and an end of a plastic part may be substantially aligned and/or coaxial such that the connection between the part and the sump outlet is substantially horizontal (when viewed from the side of the toilet).

In an exemplary test, a schedule 40 PVC pipe is coupled to a glass tile in accordance with an epoxy adhesive. Microwave energy is applied for about 30 seconds at 50% power (e.g. about 750 W). Microwave energy was applied a second time for about 30 seconds at 50% power. The assembly is submerged under water and has provided a secure seal and connection for longer than 5 months.

Present chemical/adhesive bonding may provide a solution towards connecting parts comprising dissimilar materials exposed to water and other materials. In some embodiments, a present sump connection may comprise an adhesive, and not mechanical seal. In some embodiments, adhesive bonding of a plastic trap or other plastic part to a ceramic sump outlet as described herein may provide comparable reliability to a ceramic sanitaryware product with an integrally molded trap, without the need for mechanical fasteners.

A connection may be between a plastic component and a ceramic component. Thus, any of the aforementioned components may be formed of plastic and/or ceramic such that adhesive and/or chemical bonding couples a plastic component to a ceramic component. Alternatively, the connection may be between a ceramic component and a ceramic component. Thus, any of the aforementioned components may be formed of ceramic such that adhesive and/or chemical bonding couples a ceramic component to a ceramic component. For example, although described as plastic, a trapway may be formed of ceramic. A trapway may be formed of ceramic separate from a ceramic toilet, such that coupling of the trapway to the toilet is needed. An adhesive and/or chemical bond disclosed herein may be provided to couple a ceramic trapway to a ceramic sump outlet of the toilet. Thus, the disclosure contemplates adhesive bonding a ceramic toilet bowl outlet to a ceramic glazed trapway, produced separately. A ceramic glazed trapway may be validated for design performance and assembled permanently to toilet/sump outlet with adhesive technology.

A chemical/adhesive bond of the present disclosure may eliminate future failures of conventional seal clamps, O-ring type mechanical joining devices, and other mechanical couplings. A chemical/adhesive bond of the present disclosure may permanently and structurally bond all connections with waterproof, long-life bonding.

An adhesive/chemical bond of the present disclosure may allow a transition from ceramic sanitaryware inlets and outlets to conventional, acceptable industry structures for water delivery supply and waste water elimination lines using all available seal points of connection. An adhesive/chemical bond of the present disclosure may provide a structural bond having the ability to exceed forces far beyond convention inlet water pressures supplied to sanitaryware, and all known waste lines back pressure or pressure requirements. Trap connections of the present disclosure may allow for a trapway to be formed as a separate component. A trapway may be formed of plastic. A trapway may be accessible to a user. A trapway may be hidden within smooth, flat sided walls of a toilet such that the trapway is concealed as viewed from the outside of a toilet. A trapway may be rigid to facilitate assembly. That is, a trapway may be rigid to facilitate pushing the trapway into a sleeve or wax ring in a drain connection. A trapway may have a definite shape around a heel for generating a siphon. A plastic trapway may perform better than a porcelain trapway.

A plastic trapway may be mounted to a sump outlet porcelain surface of a toilet bowl. Sump connections of the present disclosure may facilitate coupling of a plastic surface with a porcelain surface. A primary seal and a secondary seal may assist with accommodating inaccuracies in chinaware due to molding. Movement and flexibility of parts is permitted to accommodate the inaccuracies. For example, a trapway may be a rigid piece coupled to chinaware having a significant degree of variation (e.g. chinaware is cast differently and may result in variations from toilet to toilet). Present trap connections (e.g. a sump connection) may allow for flexibility of and movement of a trapway during installation. Such flexibility and movement is highly advantageous towards accommodating variations in toilets. Sump connections comprising a flexible joint allow for flexibility and movement of a trapway. A present bridge connection may also allow for flexibility and movement of a trapway, for example a flange may provide for some movement.

A jet channel pipe may be formed as a separate component. A jet channel pipe may comprise plastic. A jet channel pipe may allow for improved performance, such as faster priming due to reduction of air in the jet channel pipe. A jet channel pipe may be configured to not have "high spots" such that air does not get stuck therein, thus allowing for faster/better priming. A jet channel pipe may be formed over a steel mandrel and vulcanized. The shape of a jet channel pipe may be pre-formed.

In an embodiment, a connection for coupling a trapway to a toilet may include a sump connection, the sump connection configured to couple a trapway inlet to a sump outlet. In some embodiments, a trapway inlet and a sump outlet may be substantially coaxial and wherein each are substantially horizontal and parallel to the ground. In an embodiment, at least one trap fixing part is configured to couple a trapway to a bridge of a toilet.

According to an embodiment, a connection may include a primary seal and a secondary seal. In some embodiments, a connection may include a primary seal, a secondary seal, and a ring. A primary seal may include at least one extending radial protrusion, the at least one radial protrusion configured to seal with an interior surface of a ring. A ring may include a plate portion, the plate portion configured to distribute connection forces. A secondary seal may be configured to receive a plate portion of a ring. A primary seal may be configured to be located within a ring and a portion of the ring is configured to be received by a secondary seal. A primary seal, a secondary seal, and a ring may be configured to be fastened to a surface of the toilet.

According to an embodiment, an at least one trap fixing part may include a base portion and an upright portion extending substantially perpendicular to the base portion. An upright portion may include a recess for receiving a portion of the trapway. An at least one trap fixing part may be configured to be coupled to a bridge of a toilet and a flange on the trapway. An at least one trap fixing part may be configured to allow lateral and/or vertical movement of a trapway during installation.

According to an embodiment, a connection may include a drain connection, the drain connection including a flange, wherein the flange is configured to couple to an inner wall of a toilet and is configured to engage the trapway. In some embodiments, a drain connection may be configured as described in U.S. Pat. No. 9,212,478.

In some embodiments, a toilet assembly may include a toilet bowl and a bridge extending between interior walls of the toilet; a trapway extending between a sump outlet and a trapway outlet; and a sump connection for coupling a trapway inlet to a sump outlet. In some embodiments, a trapway may be coupled to a bridge of the toilet.

In an embodiment, a toilet assembly may include a jet channel pipe (jet channel) extending from a jet channel inlet to a jet channel outlet. A jet channel may comprise a rubber, in some cases a vulcanized rubber. According to an embodiment, a toilet assembly may include a jet nozzle, the jet nozzle configured to couple a jet channel to a jet channel outlet.

According to an embodiment, a bridge may extend from a first rear edge of a wall to a second rear edge. In some embodiments, a bridge may extend from an interior part of a wall to another interior (e.g. opposite) part of a wall. A bridge may include a recess for receiving a heel of a trapway. In some embodiments, a bridge may be formed as a separate component and coupled to toilet sidewalls or edges. In other embodiments, a bridge may be integrally formed with sidewalls or edges. In some embodiments, a bridge may be located towards or at a rear of a toilet assembly.

In some embodiments, a trapway may include an enlarged portion and at least one flange. An enlarged portion may be configured to extend around a sump connection to couple the trapway to a sump outlet. An enlarged portion may be configured to extend around and bond directly to a sump outlet. According to an embodiment, a sump connection may include a primary seal, a secondary seal, and a ring, and wherein an enlarged portion is installed over the ring. In some embodiments, a sump connection may include at least one fixing part.

In some embodiments, a trapway and a toilet may comprise dissimilar materials. According to an embodiment, a trapway may comprise a thermoplastic (plastic) and a toilet bowl and sump outlet may comprise ceramic. According to an embodiment, a sump connection may be configured to couple a plastic trapway to a ceramic toilet sump outlet without leaking. In some embodiments, a trapway may be rigid and non-flexible.

According to an embodiment, an at least one fixing part may include a recess or slotted section for receiving a flange of a trapway. A recess or slotted section may be configured to allow for movement of a rigid trapway prior to final installation.

In some embodiments, a trapway may be concealed within a base of the toilet. A toilet assembly may accommodate both a trapway and a jet channel within the base. A base may include a wall and a bridge extending between and coupling edges of the wall. Accordingly, a trapway may be concealed between (in a space between) sides of a wall. A concealed trapway may not be visible upon installation of a toilet.

In some embodiments, a toilet assembly may include a drain connection for coupling a trapway outlet to a sewer outlet in a floor. A drain connection may include a flange. A flange may be coupled to an inner wall of the toilet with one or more connection brackets and wherein the trapway outlet extends through an opening in the flange.

In some embodiments, a drain connection may also provide for flexibility and movement of a rigid trapway. Thus, in some embodiments, a rigid trapway may be "partially installed" and connected with a sump connection, a drain connection, and optionally a bridge connection, wherein one or more or all of the connections provide for flexibility and movement of the trapway prior to final complete installation. Upon final complete installation, a rigid trapway may have essentially no flexibility or movement. In some embodiments, trapway connections may be performed in any order, and each to any degree of relative completeness. For instance, in one embodiment, both a flexible sump connection and flexible drain connection may be partially installed, and then each incrementally completely installed. In another embodiment, a flexible sump connection may be partially installed, a drain connection may be completely installed, and then the sump connection may be completely installed.

A drain connection may be configured to align and connect a trapway outlet with a drain opening in a floor or in a wall.

In some embodiments, an adhesive bond may also provide for some flexibility and movement of a rigid trapway prior to the bond being fully cured and set.

According to an embodiment, a method for installing a trapway on a toilet may include installing a sump connection on a sump outlet of the toilet; coupling the trapway to the sump connection; installing at least one trap fixing part to a bridge of the toilet; and securing the trapway to the at least one fixing part. According to an embodiment, installing the sump connection may include sliding a secondary seal over the sump outlet, sliding a primary seal over the sump outlet, and installing a ring over the primary seal.

According to an embodiment, a ring may be configured to distribute connection forces over an area of a toilet. According to an embodiment, a primary seal may include at least one extending radial protrusion (radial extending ring) configured to seal within the ring. According to an embodiment, the method may include securing a trapway to a sump connection with a friction fit. According to an embodiment, the method may include installing an enlarged portion of a trapway over a sump connection.

According to an embodiment, securing a trapway to an at least one fixing part may include inserting at least one flange of the trapway within a recess of the at least one trap fixing part. According to an embodiment, the method may include installing a drain connection on an outlet of the trapway. According to an embodiment, the method may include installing the outlet of the trapway within a seal of the drain connection. According to an embodiment, the method may include installing one or more connection brackets between a flange of the drain connection and an inner wall of a base of the toilet.

According to an embodiment, a trap assembly for a toilet may include a trapway; and a flexible sleeve formed of a flexible material coupled to the trapway, wherein the sleeve is overmolded onto the trapway such that a bond is created between the trapway and the sleeve.

According to an embodiment, a trapway and/or a sump outlet adapter may include one or more surface features configured to receive and mate with a corresponding feature of a flexible sleeve. According to an embodiment, a trapway and/or a sump outlet adapter may include one or more first undercuts extending from an edge thereof and/or one or more second undercuts spaced longitudinally from the edge. According to an embodiment, one or more first undercuts may be dovetailed.

According to an embodiment, a trapway may include a flange, the flange configured to abut an end of a flexible sleeve. According to an embodiment, a sleeve is tubular. According to an embodiment, a sleeve has a bore having a varying diameter. According to an embodiment, the bore has a first bore portion and a second bore portion, wherein the first bore portion is substantially the same diameter as an inner diameter of the trapway and the second portion is larger than an outer diameter of a sump outlet of a toilet.

According to an embodiment, a flexible sleeve is formed of thermoplastic elastomer. According to an embodiment, a sleeve comprises a groove, the groove configured to receive a band clamp (hose clamp). According to an embodiment, a trap assembly may include one or more hose clamps.

According to an embodiment, a trapway may include one or more undercuts and a flexible sleeve comprises one or more portions configured to fill the one or more undercuts.

According to an embodiment, a bond is a heat bond or an adhesive bond or a combination thereof.

According to an embodiment, a trap is formed of plastic and a flexible sleeve is configured to couple the trap to a porcelain component without leaking. According to an embodiment, a trap is configured to couple to a toilet or a urinal with a flexible sleeve. According to an embodiment, the trap is formed of a first material and the sleeve is formed of a second material, and wherein the second material is more flexible than the first material.

According to an embodiment, a flexible sleeve comprises convex parts or concave parts configured to mate with a trapway. According to an embodiment, a sleeve has a primary seal and a secondary seal. According to an embodiment, a primary seal part is an inner surface of the sleeve and a secondary seal part is an outer end surface of the sleeve, the primary seal part being substantially perpendicular to the secondary seal part.

In some embodiments, a sanitaryware fixture may include a bowl having an outlet; a connection fluidly coupled to the outlet; and a tubular conduit fluidly coupled to the connection, wherein the tubular conduit has a surface feature configured to interact with the connection to provide a bond between the tubular conduit and the connection and to provide a fluid tight connection between the bowl and the tubular conduit. According to an embodiment, an outlet is a sump outlet of a bowl and a tubular conduit is a trapway, and wherein the sanitaryware fixture is a toilet. According to an embodiment, the outlet is a discharge outlet of the bowl and the tubular conduit is a discharge conduit, wherein the sanitaryware fixture is a urinal. According to an embodiment, the connection is a tubular sleeve formed of a flexible material and wherein the connection is overmolded on the tubular conduit.

According to an embodiment, a connection may include a groove configured to receive a hose clamp configured to couple the connection to the outlet of the bowl. In some embodiments, a sump connection may comprise a flexible sleeve having one or more sections configured to receive a hose clamp. In some embodiments, a reinforcement ring, for instance a plastic reinforcement ring, may be positioned under a section of a flexible sleeve configured to receive a hose clamp and over a sump outlet or over a sump outlet adapter or over a trapway.

According to an embodiment, a surface feature is one or more undercuts or concave parts and wherein a material of the connection is injected into the one or more undercuts or concave parts to provide a bond.

According to an embodiment, a surface feature is one or more protrusions or convex parts. According to an embodiment, a surface feature is one or more first undercuts or concave parts extending inward from a distal surface of the tubular conduit and one or more second undercuts or concave parts spaced longitudinally from the one or more first undercuts. According to an embodiment, a surface feature is a concave part, or a convex part or both.

According to an embodiment, a tubular conduit comprises plastic and the outlet comprises porcelain, and wherein the connection is a sleeve configured to couple the tubular conduit to the outlet without leaking.

According to an embodiment, a method for coupling a ceramic toilet to a plastic trapway may include forming the plastic trapway; molding a first end of a connection onto a first end of the plastic trapway; and coupling a second end of the connection onto the ceramic toilet, wherein the connection is heat bonded to the plastic trapway and provides a fluid tight and fluidly coupled connection between the plastic trapway and the ceramic toilet.

According to an embodiment, forming the plastic trapway comprises molding a first half of the trapway; molding a second half of the trapway; and adhering the first half of the trapway to the second half of the trapway.

According to an embodiment, molding the first end of the connection onto the first end of the plastic trapway comprises securing a mold on the first end of the plastic trapway and injecting a hot resin into the mold to form the connection. According to an embodiment, the plastic trapway comprises one or more undercuts and wherein injecting a hot resin into a mold includes injecting the hot resin into the one or more undercuts. According to an embodiment, injecting hot resin into a mold results in heat bonding the connection to the plastic trapway.

According to an embodiment, the connection is a tubular sleeve. According to an embodiment, the method may include providing a hose clamp in a groove of the connection.

According to an embodiment, coupling a second end of the connection to a ceramic toilet includes tightening a band clamp such that the connection is compressed onto the ceramic toilet. According to an embodiment, coupling a second end of the connection to a ceramic toilet includes coupling the second end of the connection to a sump outlet of the toilet.

According to an embodiment, a toilet includes a plastic trapway and a ceramic toilet bowl having a ceramic sump outlet, wherein the plastic trapway is coupled to the ceramic sump outlet with only a chemical bond and without any mechanical connections.

In some embodiments, a plastic trapway comprises schedule 40 PVC (polyvinyl chloride), chlorinated PVC (CPVC), or ABS (acrylonitrile-butadiene-styrene copolymer). In certain embodiments, a plastic trapway may comprise injection molded CPVC.

According to an embodiment, a chemical bond is formed by applying an adhesive to one or both of the plastic trapway and the ceramic toilet. According to an embodiment, an adhesive is one of or a combination of Loctite AA-H5004, Loctite AA-H3300, Loctite EAE-05MR, Loctite EAE-00NS, or Loctite EAE-00CL. According to an embodiment, a chemical bond further comprises an adhesion promoter.

According to an embodiment, a chemical bond further comprises applied energy. According to an embodiment, applied energy is one of residual heat energy from a kiln or microwave or heat energy.

According to an embodiment, a toilet may include a plastic trapway; and a ceramic toilet bowl having a ceramic sump outlet, wherein the plastic trapway is coupled to the ceramic toilet with both a chemical bond and a mechanical connection. According to an embodiment, a chemical bond is formed by applying an adhesive to one or both of the plastic trapway and the ceramic toilet, and wherein a mechanical connection comprises one or more of a flexible sleeve, a sleeve, a ring, or a seal.

According to an embodiment, a method for coupling a plastic component to a ceramic toilet may include forming a toilet of ceramic; applying an adhesive to a surface of the ceramic toilet and/or a surface the plastic component; fixing the ceramic toilet and the plastic component such that a coupling is formed; applying energy to the coupling; and allowing the adhesive to cure thus creating a chemical bond between the surface of the plastic component and the surface of the ceramic toilet. According to an embodiment, a plastic component is a plastic trapway and a surface of the ceramic toilet is a surface of a sump outlet of the toilet. According to an embodiment, applying energy comprises applying residual heat energy from a kiln where the toilet is formed and/or applying microwave energy.

According to an embodiment, a chemical bond may secure a plastic component to a ceramic toilet without additional mechanical connections.

Terms "left," "right," "upper," and "lower" may be employed to describe components with respect to their location in the figures. However, use of this terminology is not intended to limit the location of these parts to the left, right, upper, and/or lower areas of a toilet assembly and components so labeled may be located elsewhere.

The term "adjacent" means "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled". The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

All U.S. patent applications, published patent applications and patents referred to herein are hereby incorporated by reference.

Although the foregoing description is directed to certain embodiments of the invention, it is noted that other variations and modifications will be apparent to those skilled in the art, and may be made without departing from the spirit or scope of the invention. Features described in connection with one embodiment of the invention may be used in conjunction with other embodiments, even if not explicitly stated above.

The invention claimed is:

1. A toilet assembly, comprising a toilet bowl having a sump outlet;

a wall extending around the bowl from a first rear edge to a second rear edge; and a trapway, wherein the wall, the first rear edge, and the second rear edge define a space within the wall, the sump outlet comprises a portion which extends substantially horizontally outward from the toilet bowl, the sump outlet substantially horizontal portion is coupled to the trapway via a flexible sleeve, the trapway is configured to fluidly couple the sump outlet with a sewer outlet, the trapway is disposed within the space, and the trapway comprises a plastic and the toilet bowl and sump outlet comprise a ceramic.

2. The toilet assembly according to claim 1, comprising a bridge extending from the first rear edge to the second rear edge and configured to support the trapway.

3. The toilet assembly according to claim 2, wherein the trapway is coupled to the bridge.

4. The toilet assembly according to claim 2, wherein the bridge comprises a recess configured to receive a heel of the trapway.

5. The toilet assembly according to claim 2, wherein the trapway comprises a flange, and wherein the assembly comprises one or more fixing parts configured to mate with and couple to the flange.

6. The toilet assembly according to claim 5, wherein the one or more fixing parts are coupled to the bridge.

7. The toilet assembly according to claim 1, wherein the flexible sleeve comprises a thermoplastic elastomer.

8. The toilet assembly according to claim 1, wherein the flexible sleeve is configured to allow for movement of the trapway.

9. The toilet assembly according to claim 1, wherein the flexible sleeve comprises a flexible joint comprising an elastic rib encircling the flexible joint and positioned between the sump outlet and the trapway.

10. The toilet assembly according to claim 1, wherein the flexible sleeve comprises a surface feature configured to receive and mate with a corresponding surface feature of the trapway.

11. The toilet assembly according to claim 1, wherein the flexible sleeve is overmolded on the trapway.

12. The toilet assembly according to claim 1, wherein the flexible sleeve is curved.

13. The toilet assembly according to claim 1, wherein the flexible sleeve forms a primary seal with an outer surface of the sump outlet substantially horizontal portion, and forms a secondary seal with an outer surface of the toilet bowl.

14. The toilet assembly according to claim 1, wherein the trapway is concealed within the space.

15. The toilet assembly according to claim 1, wherein the flexible sleeve comprises a radial concave portion configured to receive and mate with a radial convex portion of the trapway.

16. The toilet assembly according to claim 1, comprising a drain connection configured to couple the trapway to a sewer outlet.

17. The toilet assembly according to claim 1, comprising a drain connection configured to couple the trapway to a sewer outlet, and wherein the drain connection is configured to couple to the wall.

18. The toilet assembly according to claim 1, comprising a jet channel pipe extending from a jet channel inlet to a jet channel outlet.

19. The toilet assembly according to claim 18, wherein the jet channel pipe comprises a rubber and/or a thermoplastic.

* * * * *